US010449657B2

(12) United States Patent
LeCompte

(10) Patent No.: US 10,449,657 B2
(45) Date of Patent: Oct. 22, 2019

(54) TANK ASSEMBLY AND METHOD OF USE

(71) Applicant: MMLJ, Inc., Houston, TX (US)

(72) Inventor: Benjamin LeCompte, Houston, TX (US)

( * ) Notice: Subject to any disclaimer, the term of this patent is extended or adjusted under 35 U.S.C. 154(b) by 202 days.

(21) Appl. No.: 15/712,453

(22) Filed: Sep. 22, 2017

(65) Prior Publication Data

US 2018/0079054 A1 Mar. 22, 2018

Related U.S. Application Data

(63) Continuation-in-part of application No. 14/773,694, filed as application No. PCT/US2014/022170 on Mar. 7, 2014.

(60) Provisional application No. 61/773,816, filed on Mar. 7, 2013, provisional application No. 62/398,225, filed on Sep. 22, 2016.

(51) Int. Cl.

| | |
|---|---|
| ***B24C 7/00*** | (2006.01) |
| ***B24C 9/00*** | (2006.01) |
| ***F17C 13/04*** | (2006.01) |

(52) U.S. Cl.

CPC ..... *B24C 7/0007* (2013.01); *B24C 9/00* (2013.01); *F17C 13/04* (2013.01); *F17C 2201/0142* (2013.01); *F17C 2201/032* (2013.01); *F17C 2209/221* (2013.01)

(58) Field of Classification Search

CPC . B24C 7/0007; B24C 9/00; F17C 2201/0142; F17C 2201/032; F17C 2209/221

USPC ..... 451/64, 99

See application file for complete search history.

(56) References Cited

U.S. PATENT DOCUMENTS

| | | | | | |
|---|---|---|---|---|---|
| 794,507 | A * | 7/1905 | King | B24C 7/0046 | 451/91 |
| 819,922 | A * | 5/1906 | Radell | B24C 1/02 | 451/79 |
| 925,591 | A * | 6/1909 | Pangborn | B24C 7/0046 | 406/133 |
| 979,897 | A * | 12/1910 | Steedman | B24C 7/0046 | 451/102 |
| 2,815,716 | A * | 12/1957 | Ransohoff | B24C 7/0007 | 415/116 |
| 3,741,738 | A * | 6/1973 | Dowgin | B24C 7/0046 | 451/99 |
| 3,791,078 | A * | 2/1974 | Fleisher | B24C 3/02 | 451/101 |

(Continued)

*Primary Examiner* — George B Nguyen
(74) *Attorney, Agent, or Firm* — Shannon L Warren

(57) ABSTRACT

A tank assembly. Said tank assembly comprises a one or more blister assemblies, a shell assembly, a one or more air inlet hoses, a one or more spray equipment and a slurry mixture. Said one or more blister assemblies comprises a first blister assembly and a second blister assembly. Said one or more blister assemblies comprise a one or more draw tubes, a one or more cone flanges, a one or more head assemblies, a one or more shells, a one or more cone assemblies, an air line assembly, a one or more snorkel assemblies, and a separation distance. Said one or more draw tubes comprise a first draw tube and a second draw tube. Said separation distance between said one or more draw tubes is configured to allow said one or more spray equipment to rotate freely on said one or more draw tubes without interfering with one another.

5 Claims, 46 Drawing Sheets

(56) References Cited

U.S. PATENT DOCUMENTS

| | | | | | |
|---|---|---|---|---|---|
| 3,994,097 | A * | 11/1976 | Lamb | B24C 5/02 | 451/40 |
| 5,097,633 | A * | 3/1992 | Branton | B24C 7/0053 | 451/101 |
| 5,393,228 | A * | 2/1995 | Policicchio | A61C 3/025 | 433/88 |
| 5,433,653 | A * | 7/1995 | Friess | B24C 1/003 | 451/100 |
| 8,342,912 | B2 * | 1/2013 | Funatsu | B24C 1/00 | 451/100 |
| 2008/0287039 | A1 * | 11/2008 | Connelly | B24C 3/06 | 451/38 |
| 2009/0075569 | A1 * | 3/2009 | Mase | B24C 3/02 | 451/99 |
| 2010/0210191 | A1 * | 8/2010 | Nguyen | B24C 7/0046 | 451/91 |
| 2013/0072094 | A1 * | 3/2013 | Eliason | B24C 7/0007 | 451/75 |
| 2016/0193715 | A1 * | 7/2016 | Nash | B24C 7/00 | 451/99 |

* cited by examiner

100

DETAIL A

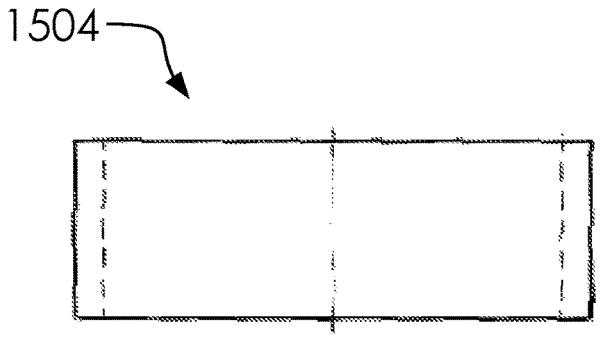
FIG. 17A
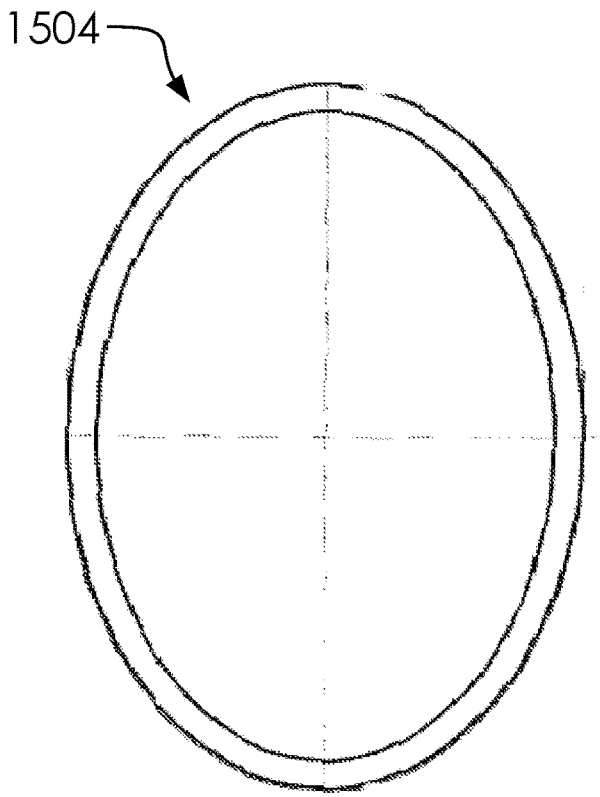
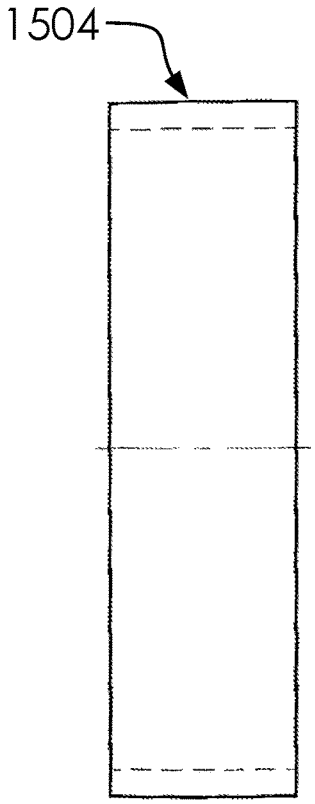
FIG. 17B FIG. 17C

SECTION 3-3

130a, 130

SECTION M-M 130a, 130

LIP DETAIL V
SCALE 10 : 1

TANK ASSEMBLY AND METHOD OF USE

CROSS-REFERENCE TO RELATED APPLICATIONS

This application claims benefit to U.S. Patent Application No. 61/773,816 filed on Mar. 7, 2013, PCT/US14/22170 filed on Mar. 7, 2014, Ser. No. 14/773,694 filed on Sep. 8, 2015, Ser. No. 14/848,330 filed on Sep. 8, 2015 and 62/398,225 filed on Sep. 22, 2016.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

None of the known inventions and patents, taken either singularly or in combination, is seen to describe the instant disclosure as claimed.

BRIEF SUMMARY OF THE INVENTION

A tank assembly. Said tank assembly comprises a one or more blister assemblies, a shell assembly, a one or more air inlet hoses, a one or more spray equipment and a slurry mixture. Said one or more blister assemblies comprises a first blister assembly and a second blister assembly. Said one or more blister assemblies comprise a one or more draw tubes, a one or more cone flanges, a one or more head assemblies, a one or more shells, a one or more cone assemblies, an air line assembly, a one or more snorkel assemblies, and a separation distance. Said one or more draw tubes comprise a first draw tube and a second draw tube. Said separation distance between said one or more draw tubes is configured to allow said one or more spray equipment to rotate freely on said one or more draw tubes without interfering with one another. Said one or more draw tubes selectively mate with said one or more cone flanges. Said one or more cone flanges are attached at a lower point in said one or more cone assemblies and gather portions of said slurry mixture. Said tank assembly is configured to selectively channel said slurry mixture into said one or more draw tubes by opening a gap between said one or more draw tubes and said one or more cone flanges.

A tank assembly. Said tank assembly comprises a one or more blister assemblies, a shell assembly, a one or more air inlet hoses, a one or more spray equipment and a slurry mixture. Said one or more blister assemblies comprises a first blister assembly and a second blister assembly. Said one or more blister assemblies comprise a one or more draw tubes, a one or more cone flanges, a one or more head assemblies, a one or more shells, a one or more cone assemblies, an air line assembly, a one or more snorkel assemblies, and a separation distance. Said one or more draw tubes comprise a first draw tube and a second draw tube.

BRIEF DESCRIPTION OF THE SEVERAL VIEWS OF THE DRAWING

FIG. 17A illustrates an elevated top side view of a hand hole rings 1504.

FIG. 17B illustrates an elevated front side view of a hand hole rings 1504.

FIG. 17C illustrates an elevated first side view of a hand hole rings 1504.

DETAILED DESCRIPTION OF THE INVENTION

Figure 1A:
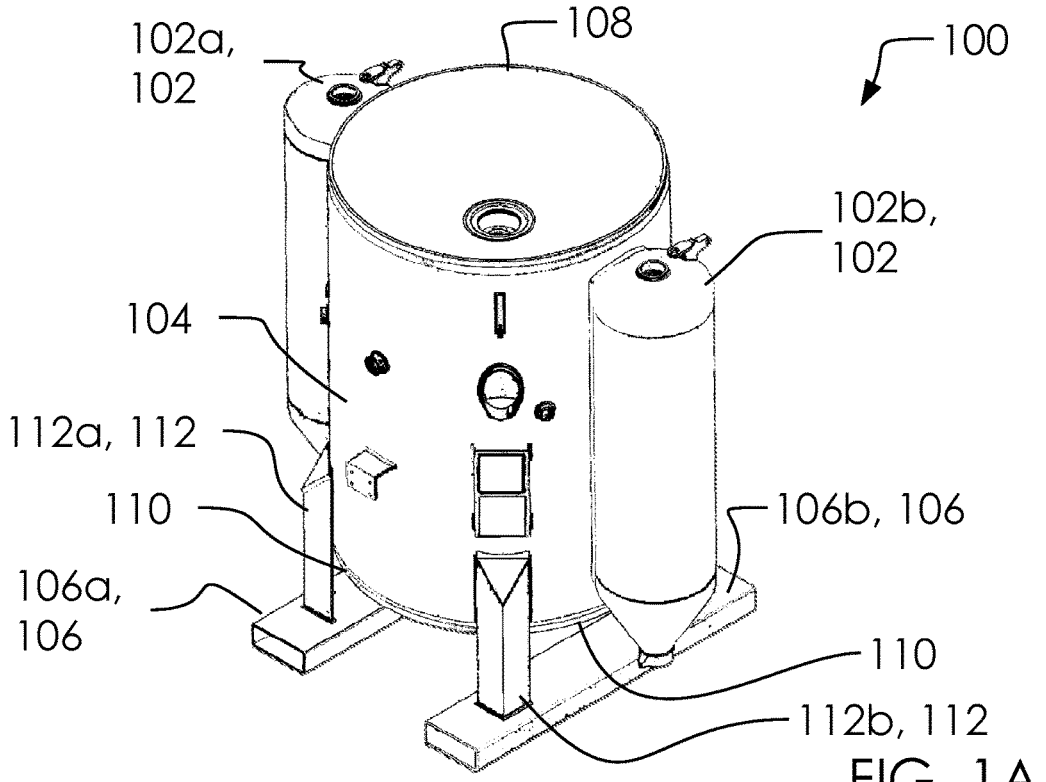
FIG. 1A illustrates a perspective first side view of a tank assembly 100.

The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

These parts are illustrated in the figures and discussed below:

a tank assembly 100
a one or more blister assemblies 102
a first blister assembly 102*a*
a second blister assembly 102*b*
a shell assembly 104
a one or more leg assemblies 106
a first leg assembly 106*a*
a second leg assembly 106*b*
a head assembly 108
a cone assembly 110
a one or more leg covers 112
a first leg cover 112*a*
a second leg cover 112*b*
a third leg cover 112*c*
a fourth leg cover 112*d*
a slurry mixture 114
a one or more draw tubes 116
a first draw tube 116*a*
a second draw tube 116*b*
a one or more cone flanges 118
a first cone flange 118*a*
a second cone flange 118*b*
a one or more head assemblies 120
a first head assembly 120*a*
a second head assembly 120*b*
a one or more shells 122
a first shell 122*a*
a second shell 122*b*
a one or more cone assemblies 124
a first cone assembly 124*a*
a second cone assembly 124*b*
a one or more lower apertures 126
a first lower aperture 126*a*
a second lower aperture 126*b*
a one or more middle apertures 127
a first middle aperture 127*a*
a second middle aperture 127*b*
a one or more upper apertures 128
a first upper aperture 128*a*
a second upper aperture 128*b*
a one or more blister couplings 130
a first blister coupling 130*a*
a second blister coupling 130*b*
a one or more rocker arm pedestals 202
a first rocker arm pedestal 202*a*
a second rocker arm pedestal 202*b*
a one or more hoisting lugs 204
a first hoisting lug 204*a*
a second hoisting lug 204*b*
a one or more control box mounting bracket 206
a first control box mounting bracket 206*a*
a second control box mounting bracket 206*b*
a third control box mounting bracket 206*c*
a fourth control box mounting bracket 206*d*
an airline bracket 208
a name plate bracket 210
a name plate 212
a warning plate 214
a one or more sides 216
a first side 216*a*
a second side 216*b*
an outer body 218
an air line assembly 300
a nipple 302
a close nipple 304
a one or more elbows 306
a first elbow 306*a*
a second elbow 306*b*
a nipple 308
a moody nut gasket 310
a moody nut 312
a nipple TOE 314
a reducing elbow 316
an adjustable nipple 318
a pop-up cylinder assembly 320
a fill ring 322
a fill plug seat ring 324
a snap ring 326
a one or more vibrator mounting brackets 328
a first vibrator mounting bracket 328*a*
a second vibrator mounting bracket 328*b*
a one or more snorkel assemblies 330
a first snorkel assembly 330*a*
a second snorkel assembly 330*b*
a head 902
a fill ring 904
a reinforcement ring 906
a coupling 908
a tripod support 910
a first support 910*a*
a second support 910*b*
a third support 910*c*
a head top 1002
a full couplings 1502
a hand hole rings 1504
a one or more threaded couplings 1506
a first threaded coupling 1506*a*
a second threaded coupling 1506*b*
a one or more nipples 1508
a first nipple 1508*a*
a second nipple 1508*b*
a one or more elbow 1510
a first elbow 1510*a*
a second elbow 1510*b*
a one or more pipe 1512
a first pipe 1512*a*
a second pipe 1512*b*
a half coupling 1514
an interior volume 1516
an exterior environment 1518
a first side 1800*a*
a second side 1800*b*
a front side 1800*c*
a back side 1800*d*
a one or more bridges 1802
a first bridge 1802*a*
a second bridge 1802*b*
a one or more spider guides 1902 a first spider guide 1902*a*
a second spider guide 1902*b*
a cone body 2002
a cone cap plate 2004
a blister head 2302
a blister coupling 2304
a cone flange 2802
a center aperture 3002
a one or more extensions 3004
a first extension 3004*a*
a second extension 3004*b*
a third extension 3004*c*
a one or more right apertures 3006
a first right aperture 3006*a*
a second right aperture 3006*b*
a third right aperture 3006*c*
a one or more left apertures 3008
a first left aperture 3008*a*
a second left aperture 3008*b*
a third left aperture 3008*c*
a center aperture 3102
a one or more threaded sockets 3104
a first threaded socket 3104*a*
a second threaded socket 3104*b*
an upper fitting 3106
a lower fitting 3108
a center gap 3110
a center aperture 3402
a first side 3702
a second side 3704
a one or more vibrators 3802
a first vibrator 3802*a*
a second vibrator 3802*b*
a one or more spray equipment 3902
a first spray equipment 3902*a*
a second spray equipment 3902*b*
a separation distance 3904
a one or more control boxes 4000
a first control box 4000*a*
a second control box 4000*b*
a one or more air inlet hoses 4002
a first air inlet hose 4002*a*
a second air inlet hose 4002*b*
a one or more handles 4004
a first handle 4004*a*
a second handle 4004*b*
a cap 4006
a first configuration 4400
a second configuration 4402
a spray slurry 4600
a nozzle 4602

FIG. 1A illustrates a perspective first side view of a tank assembly 100.

Figure 1B:
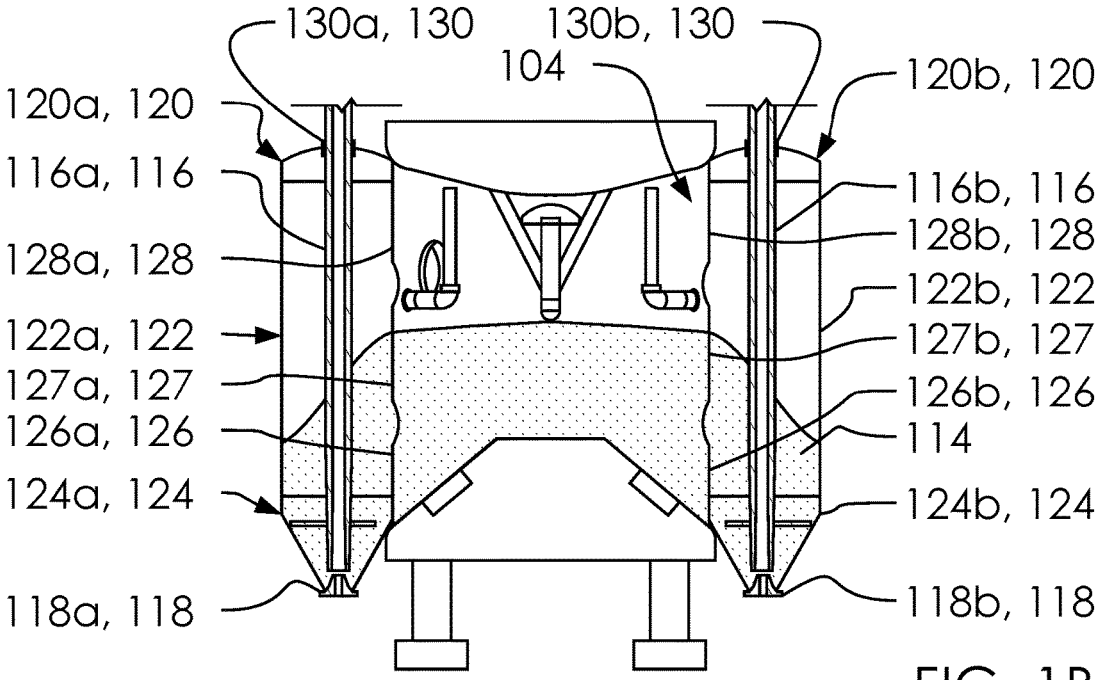
FIG. 1B illustrates an elevated front side view of a tank assembly 100 in cross-section.

FIG. 1B illustrates an elevated front side view of a tank assembly 100 in cross-section.

In one embodiment, said tank assembly 100 can comprise said one or more blister assemblies 102, said shell assembly 104, said one or more leg assemblies 106, said head assembly 108, said cone assembly 110 and said second upper aperture 128*b*.

In one embodiment, said one or more blister assemblies 102 can comprise said first blister assembly 102*a*, said second blister assembly 102*b*, said slurry mixture 114, said second draw tube 116*b*, said second cone flange 118*b*, said second cone flange 118*b*, said second head assembly 120*b*, said second shell 122*b*, said second cone assembly 124*b*, said second lower aperture 126*b*, said second middle aperture 127*b* and said second blister coupling 130*b*.

In one embodiment, said first blister assembly 102*a* can comprise said first cone flange 118*a*.

In one embodiment, said second blister assembly 102*b* can comprise said second cone flange 118*b*.

In one embodiment, said one or more leg assemblies 106 can comprise said one or more leg covers 112.

In one embodiment, said one or more leg covers 112 can comprise said first leg cover 112*a*, said second leg cover 112*b*, said third leg cover 112*c* and said fourth leg cover 112*d*.

In one embodiment, said one or more draw tubes 116 can comprise said first draw tube 116*a* and said second draw tube 116*b*.

In one embodiment, said one or more cone flanges 118 can comprise said first cone flange 118*a* and said second cone flange 118*b*.

In one embodiment, said one or more head assemblies 120 can comprise said first head assembly 120*a*, said second head assembly 120*b* and said one or more blister couplings 130.

In one embodiment, said first head assembly 120*a* can comprise said first blister coupling 130*a*.

In one embodiment, said second head assembly 120*b* can comprise said second blister coupling 130*b*.

In one embodiment, said one or more shells 122 can comprise said first shell 122*a* and said second shell 122*b*.

In one embodiment, said one or more cone assemblies 124 can comprise said first cone assembly 124*a* and said second cone assembly 124*b*.

In one embodiment, said one or more lower apertures 126 can comprise said first lower aperture 126*a* and said second lower aperture 126*b*.

In one embodiment, said one or more upper apertures 128 can comprise said first upper aperture 128*a* and said second upper aperture 128*b*.

In one embodiment, said one or more blister couplings 130 can comprise said first blister coupling 130*a* and said second blister coupling 130*b*.

In one embodiment, said one or more middle apertures 127 can comprise said first middle aperture 127*a* and said second middle aperture 127*b*.

Said tank assembly 100 can comprise a system for spraying a dustless stream for removal of paint, grime, chemicals, or similar.

Said tank assembly 100 is similar to a system(s) incorporated by reference to this application (Ser. No. 14/848,330 filed on Sep. 8, 2015, Ser. No. 14/773,694 filed on Sep. 8, 2015, PCT/US14/22170 filed on Mar. 7, 2014 and 61/773,816 filed on Mar. 7, 2013) but with at least one distinction in that said one or more blister assemblies 102 are designed to provide more than one outflowing stream from said tank assembly 100.

Said one or more leg assemblies 106 can support upper portions of said tank assembly 100, such as said one or more blister assemblies 102 and said shell assembly 104, as illustrated.

In one embodiment, said one or more blister assemblies 102 and said shell assembly 104 can comprise three chambers for storing and distributing said slurry mixture 114.

In one embodiment, said slurry mixture 114 can comprise a proprietary mixture of abrasive and fluids such as water.

Said one or more blister assemblies 102 and said shell assembly 104 are in fluid connection at said one or more lower apertures 126 and said one or more upper apertures 128 which allow portions of said slurry mixture 114 to:

beginning in said shell assembly 104 and then slide down and into said one or more blister assemblies 102 toward said one or more cone flanges 118 and the bottom portion of said one or more draw tubes 116.

Said one or more draw tubes 116 and said 118 can operate as with the parent application to this application, namely the pickup and delivery of said slurry mixture 114 through said one or more draw tubes 116 with assistance of an air hose (discussed below) attached to said one or more cone flanges 118.

Said one or more leg assemblies 106 are optional and comprise a means of supporting the weight and mass of said tank assembly 100, as is known in the art. In one embodiment, said tank assembly 100 can be built into a trailer.

In one embodiment, said one or more blister couplings 130 can allow portions of said one or more draw tubes 116 to pass into and out of said one or more blister assemblies 102 without breaking a seal between the volume within said one or more blister assemblies 102 and the outside environment.

Figure 2A:
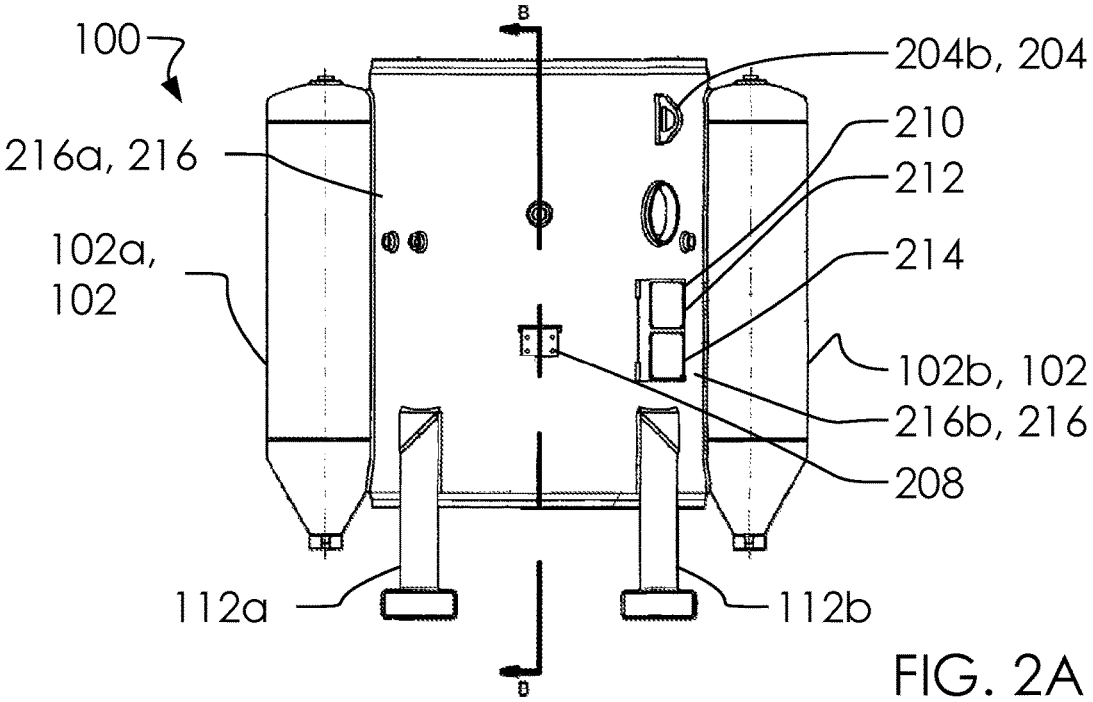
FIG. 2A illustrates an elevated front side view of a tank assembly 100.

FIG. 2A illustrates an elevated front side view of a tank assembly 100.

Figure 2B:
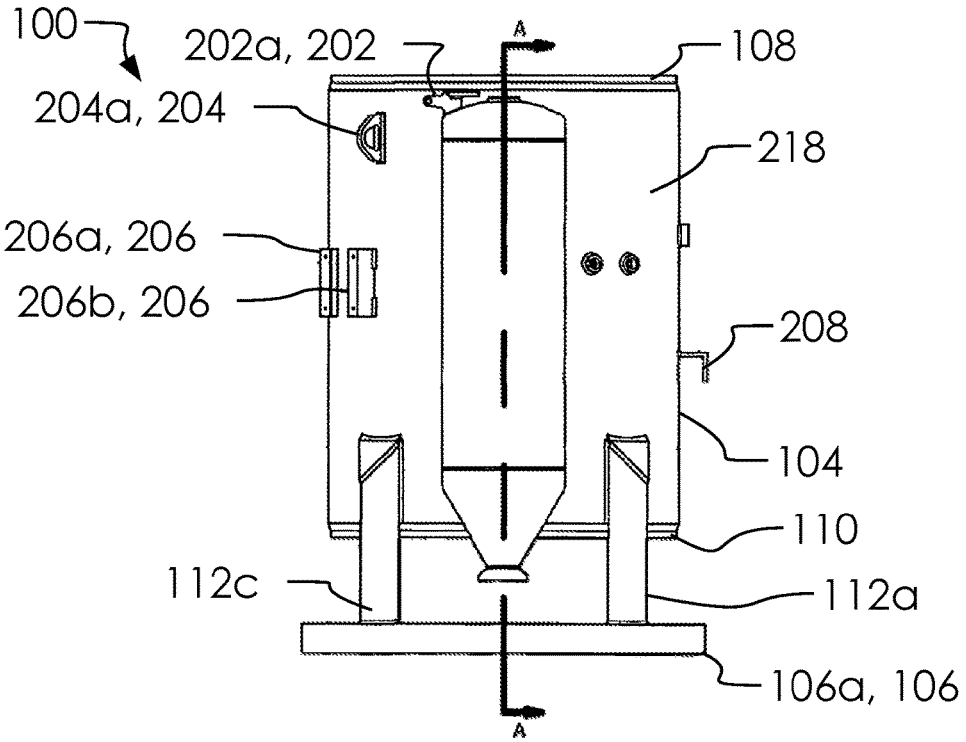
FIG. 2B illustrates an elevated first side view of a tank assembly 100.

FIG. 2B illustrates an elevated first side view of a tank assembly 100.

In one embodiment, said one or more rocker arm pedestals 202 can comprise said first rocker arm pedestal 202*a* and said second rocker arm pedestal 202*b*.

In one embodiment, said one or more control box mounting bracket 206 can comprise said first control box mounting bracket 206*a*, said second control box mounting bracket 206*b*, said third control box mounting bracket 206*c* and said fourth control box mounting bracket 206*d*.

In one embodiment, said one or more sides 216 can comprise said first side 216*a* and said second side 216*b*.

In one embodiment, said tank assembly 100 can comprise said one or more rocker arm pedestals 202, said one or more hoisting lugs 204, said one or more control box mounting bracket 206, said airline bracket 208, said name plate bracket 210, said name plate 212 and said warning plate 214.

In one embodiment, said shell assembly 104 can comprise said one or more rocker arm pedestals 202, said one or more hoisting lugs 204, said one or more control box mounting bracket 206, said airline bracket 208, said name plate bracket 210, said name plate 212, said warning plate 214 and said outer body 218.

Said one or more rocker arm pedestals 202 can allow for the attachment of a rocker arm, as discussed below.

Said parts 204-214 can attach to various exterior locations of said shell assembly 104 as illustrated and known in the art.

In one embodiment, said shell assembly 104 can comprise a substantially cylindrical vessel with said one or more blister assemblies 102 attached on said one or more sides 216.

Said tank assembly 100 can comprise a stainless steel material.

In one embodiment, said one or more hoisting lugs 204 can be useful for lifting and moving portions of said tank assembly 100.

Said one or more control box mounting bracket 206 can hold a control system, as is known in the art.

Figure 3A:
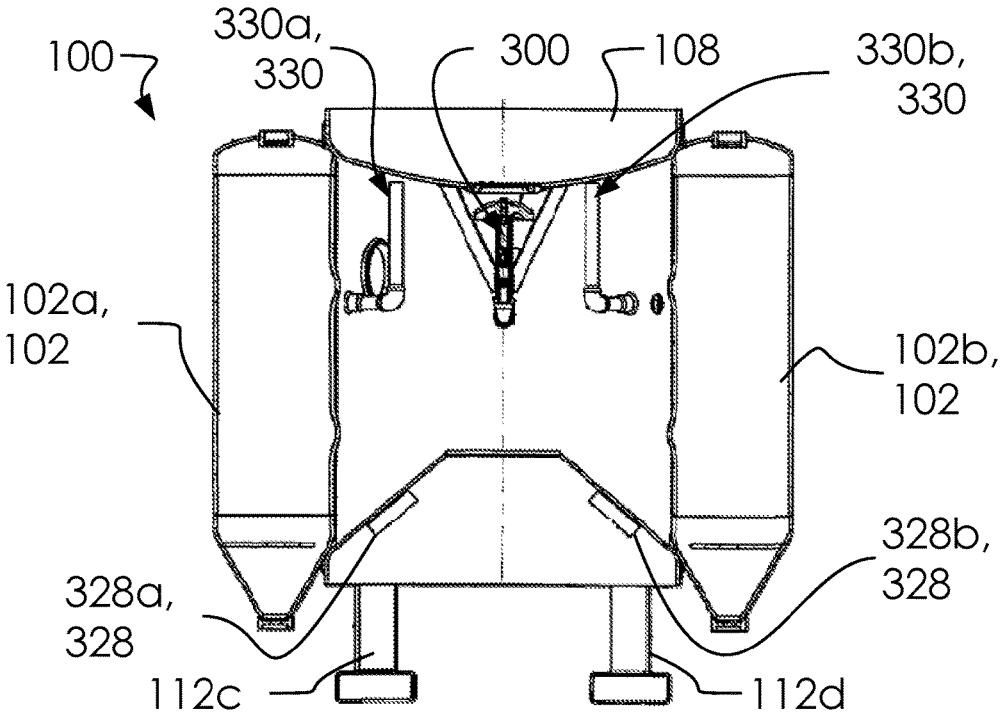
FIG. 3A illustrates an elevated front side view of a tank assembly 100 at cross-section A-A.

FIG. 3A illustrates an elevated front side view of a tank assembly 100 at cross-section A-A.

Figure 3B:
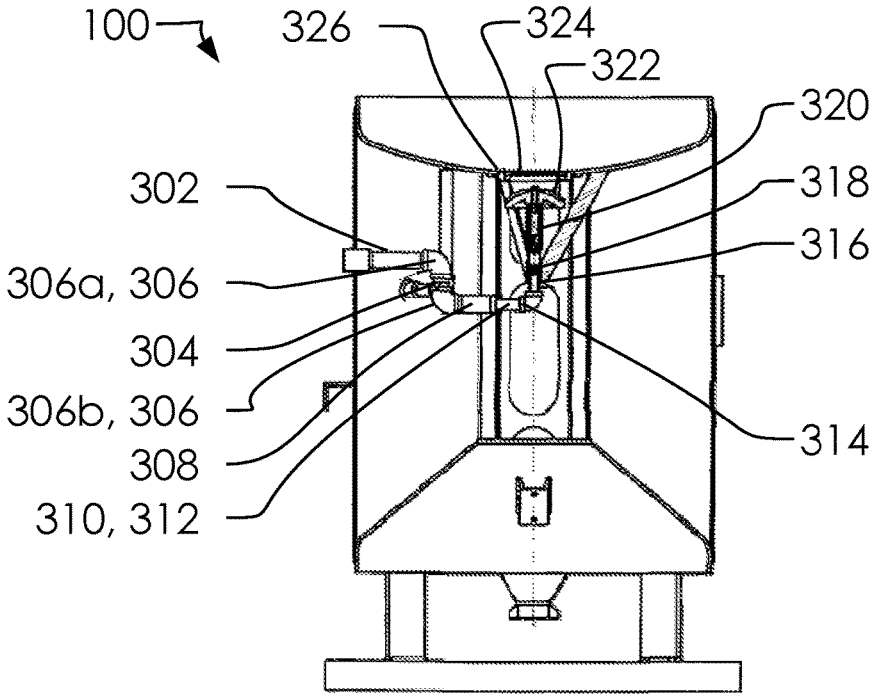
FIG. 3B illustrates an elevated first side view of a tank assembly 100 at cross-section B-B.

FIG. 3B illustrates an elevated first side view of a tank assembly 100 at cross-section B-B.

In one embodiment, said one or more elbows 306 can comprise said first elbow 306*a* and said second elbow 306*b*.

In one embodiment, said one or more vibrator mounting brackets 328 can comprise said first vibrator mounting bracket 328*a* and said second vibrator mounting bracket 328*b*.

In one embodiment, said air line assembly 300 can comprise said nipple 302, said close nipple 304, said one or more elbows 306, said nipple 308, said moody nut gasket 310, said moody nut 312, said nipple TOE 314, said reducing elbow 316, said adjustable nipple 318, said pop-up cylinder assembly 320, said fill ring 322, said fill plug seat ring 324 and said snap ring 326.

In one embodiment, said one or more snorkel assemblies 330 can comprise said first snorkel assembly 330*a* and said second snorkel assembly 330*b*.

In one embodiment, said tank assembly 100 can comprise said air line assembly 300, said air line assembly 300, said nipple 302, said close nipple 304, said one or more elbows 306, said nipple 308, said moody nut gasket 310, said moody nut 312, said nipple TOE 314, said reducing elbow 316, said adjustable nipple 318, said pop-up cylinder assembly 320, said fill ring 322, said fill plug seat ring 324, said snap ring 326, said one or more vibrator mounting brackets 328 and said one or more snorkel assemblies 330.

In one embodiment, said air line assembly 300 can comprise a plumbing assembly. Likewise, said one or more snorkel assemblies 330 are adapted to create a fluid connection between an outside environment and the interior of said tank assembly 100.

Said pop-up cylinder assembly 320, said fill ring 322, said fill plug seat ring 324 and said snap ring 326 can mate with said head assembly 108. In one embodiment, said head assembly 108 can receive a portion of said slurry mixture 114 for filling said shell assembly 104 and said one or more blister assemblies 102.

Figure 4A:
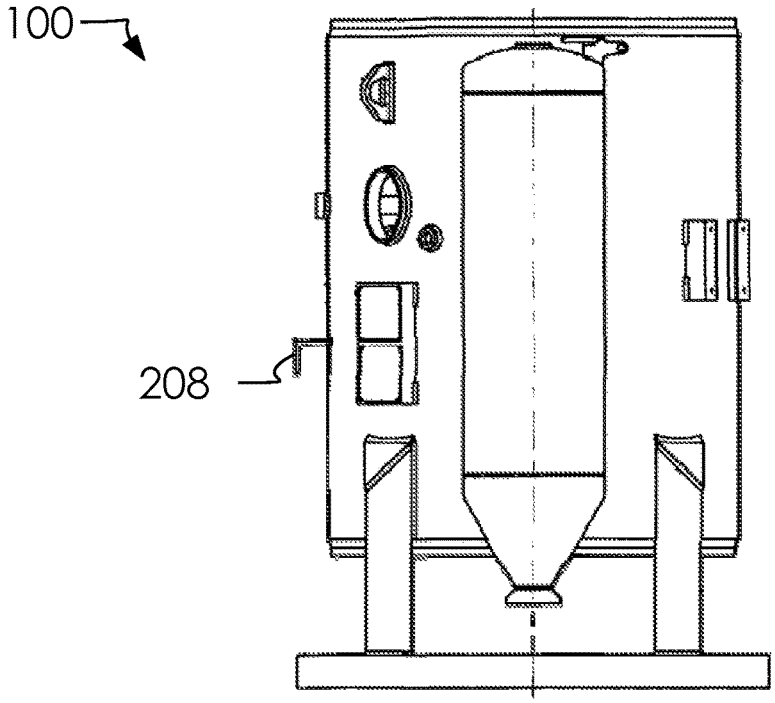
FIG. 4A illustrates an elevated second side view of a tank assembly 100.

FIG. 4A illustrates an elevated second side view of a tank assembly 100.

Figure 4B:
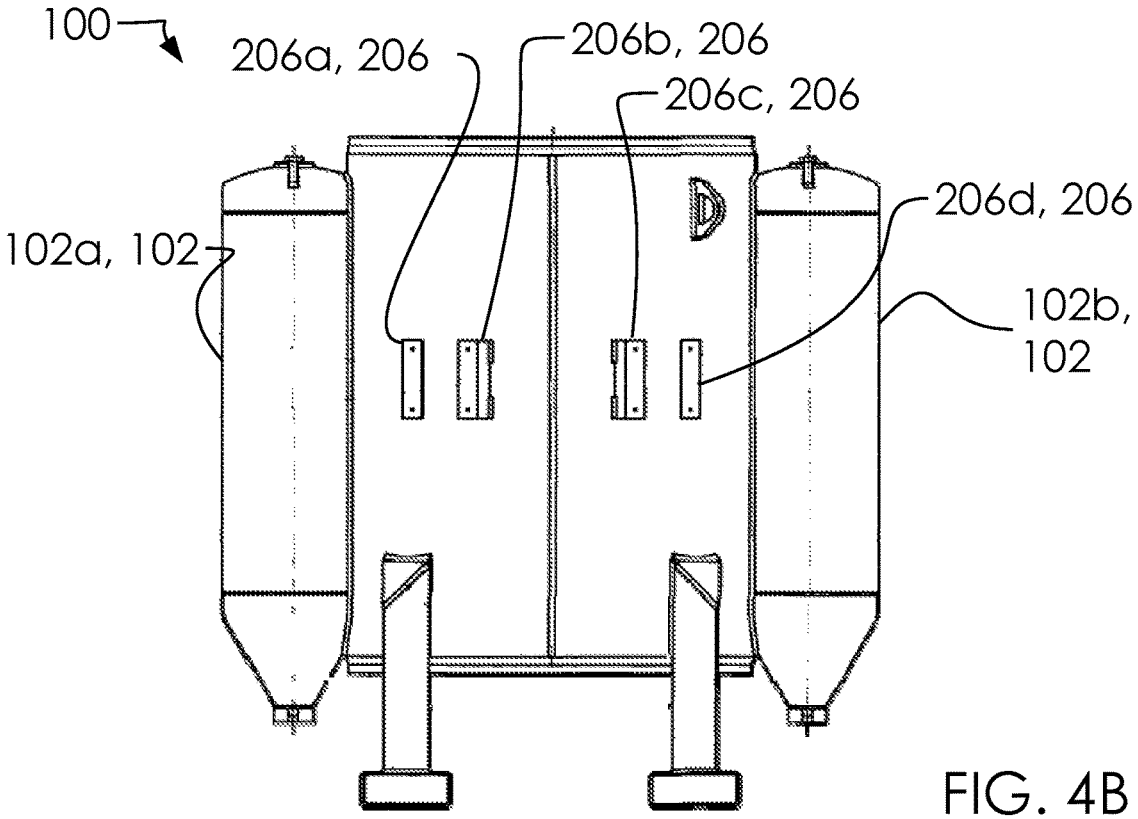
FIG. 4B illustrates an elevated back side view of a tank assembly 100.

FIG. 4B illustrates an elevated back side view of a tank assembly 100.

In one embodiment, all welding and fabrication can be done in accordance with ASME boiler and pressure vessel code for unfired pressure vessels. Working pressure can comprise up to 150 PSI and working temperature of 300 degrees F. In one embodiment, said tank assembly 100 can comprise a volume of 25.48 cubic feet.

Figure 5A:
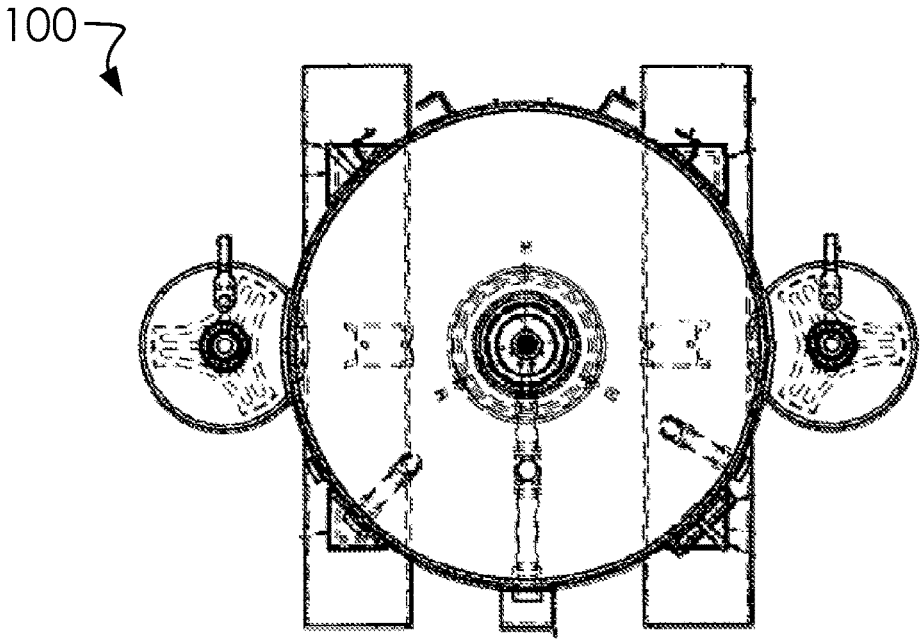
FIG. 5A illustrates an elevated top side view of a tank assembly 100 with underlying structure in dashed lines.

FIG. 5A illustrates an elevated top side view of a tank assembly 100 with underlying structure in dashed lines.

Figure 5B:
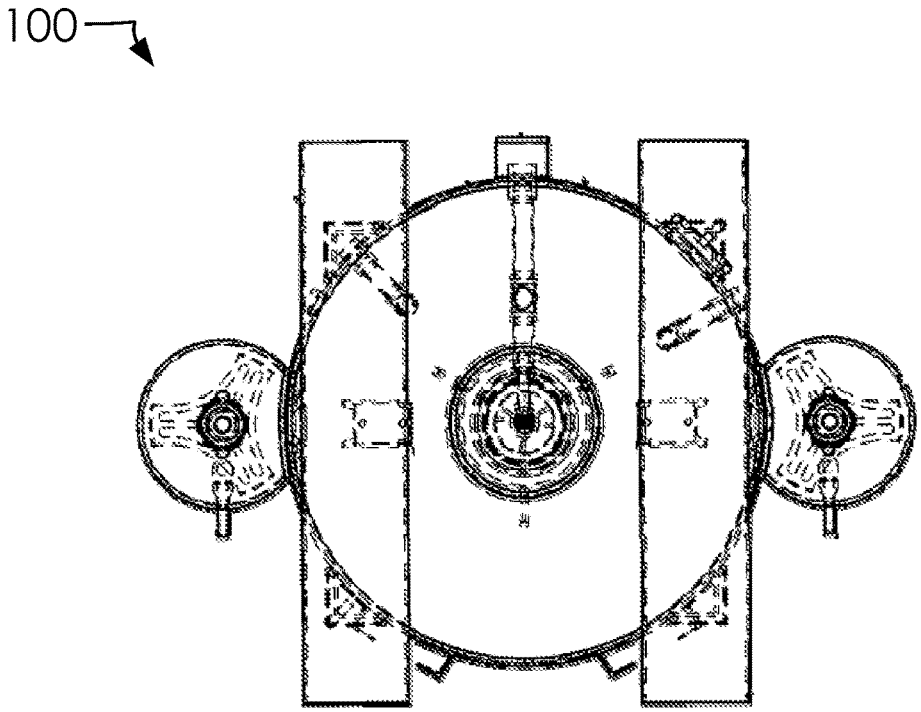
FIG. 5B illustrates an elevated bottom side view of a tank assembly 100 with underlying structure in dashed lines.

FIG. 5B illustrates an elevated bottom side view of a tank assembly 100 with underlying structure in dashed lines.

Figure 6:
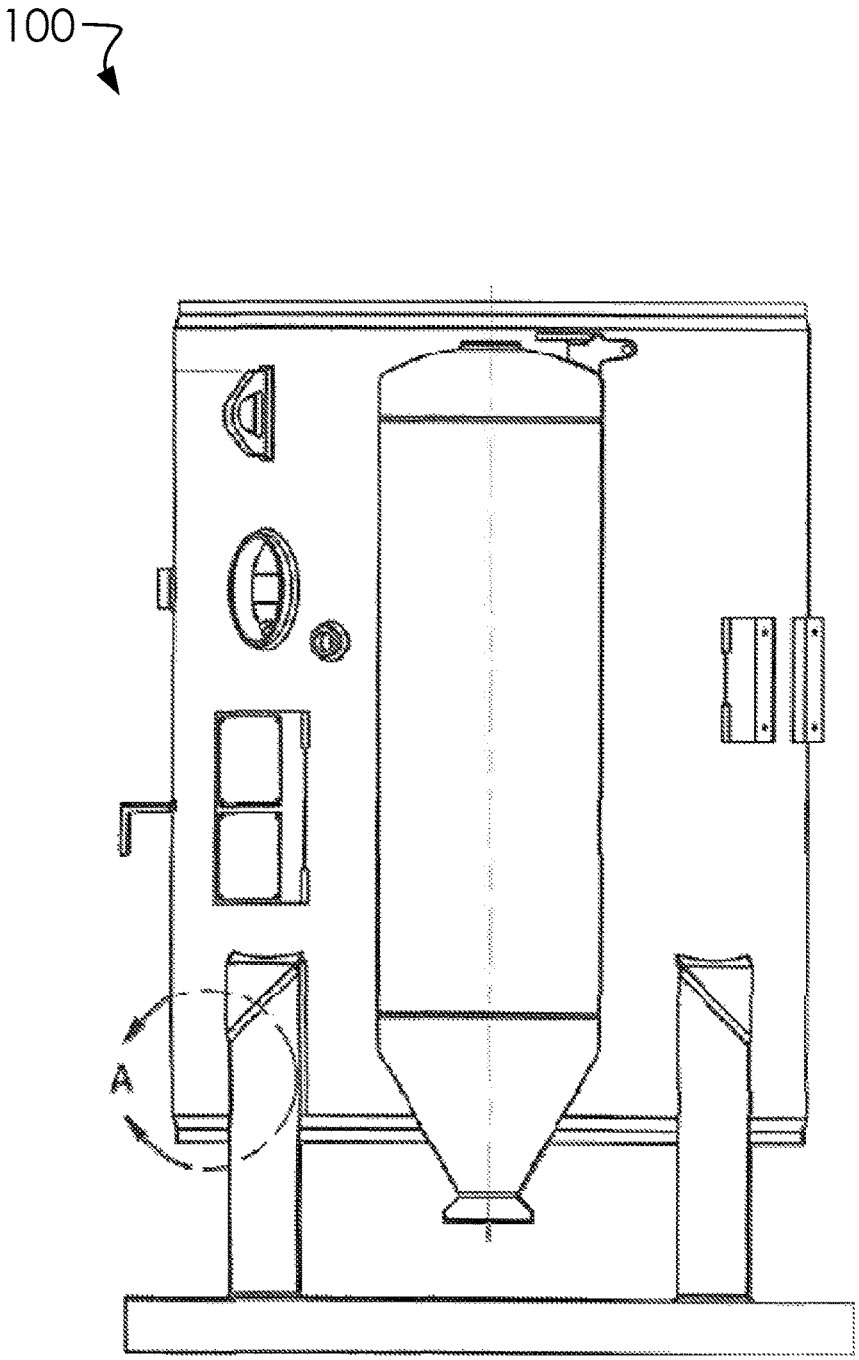
FIG. 6 illustrates an elevated first side view of a tank assembly 100.

FIG. 6 illustrates an elevated first side view of a tank assembly 100.

Figure 7:
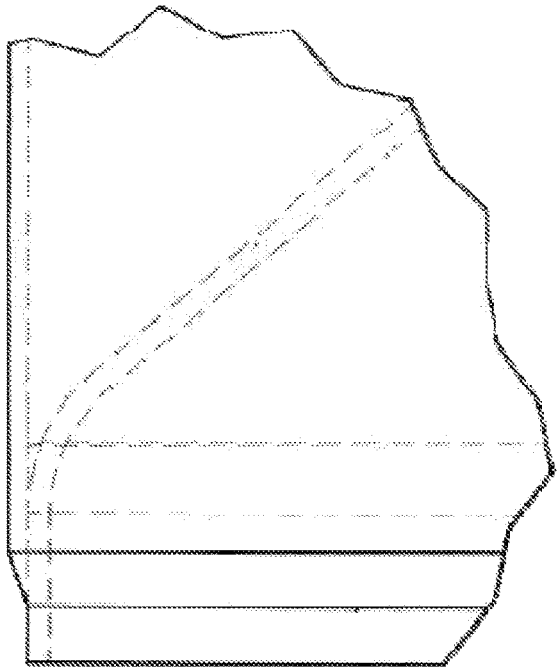
FIG. 7 illustrates an elevated detailed view of a tank assembly 100.

FIG. 7 illustrates an elevated detailed view of a tank assembly 100.

Figure 8:
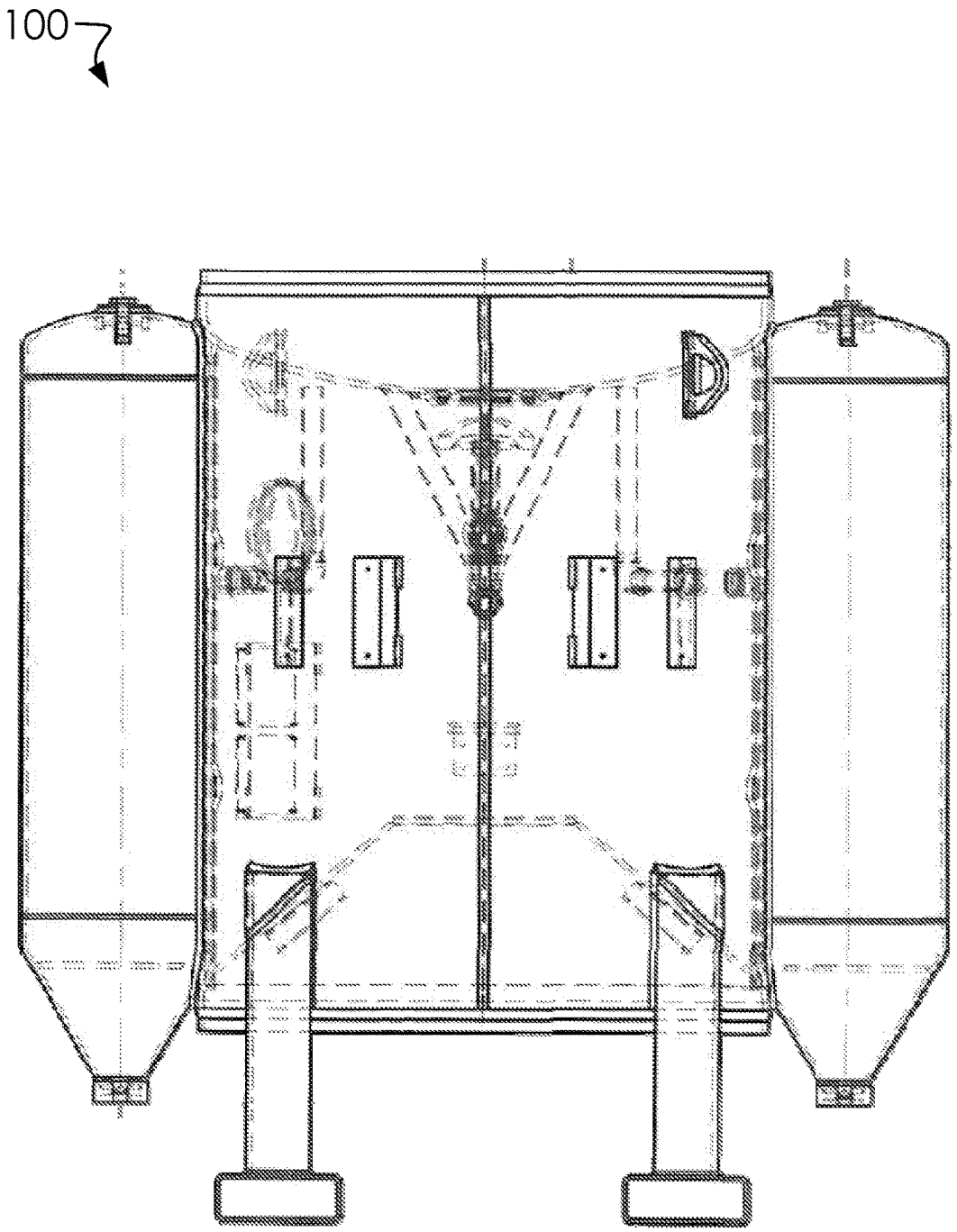
FIG. 8 illustrates an elevated front side view of a tank assembly 100 with underlying structure in dashed lines.

FIG. 8 illustrates an elevated front side view of a tank assembly 100 with underlying structure in dashed lines.

Figure 9A:
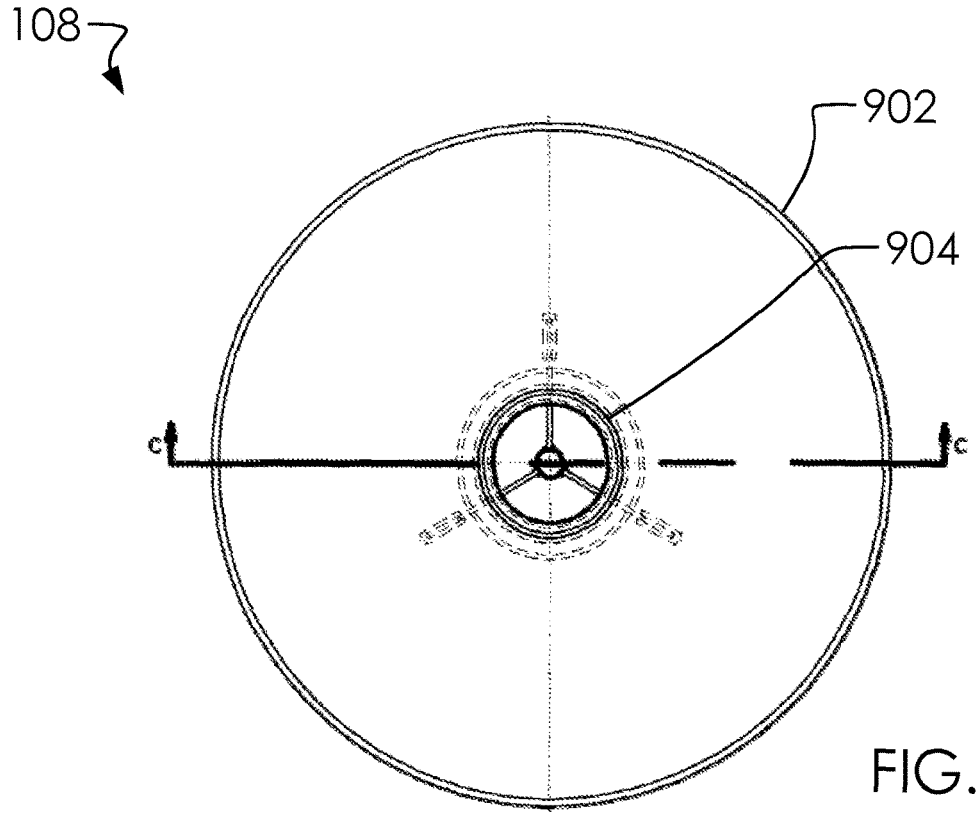
FIG. 9A illustrates an elevated top side view of a head assembly 108.

FIG. 9A illustrates an elevated top side view of a head assembly 108.

Figure 9B:
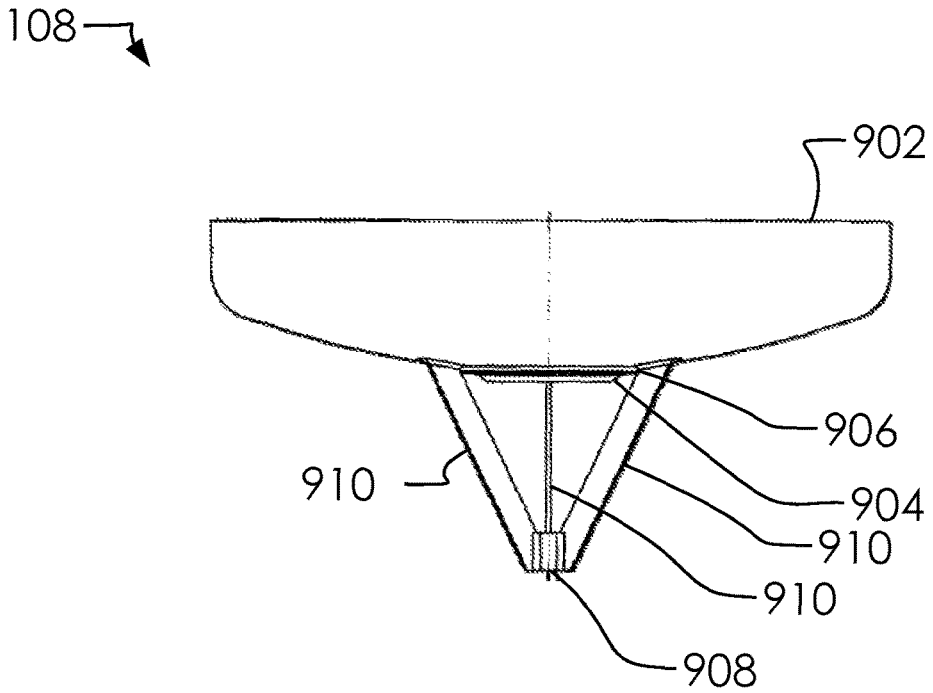
FIG. 9B illustrates an elevated first side view of a head assembly 108.

FIG. 9B illustrates an elevated first side view of a head assembly 108.

In one embodiment, said tripod support 910 can comprise said first support 910*a*, said second support 910*b* and said third support 910*c*.

In one embodiment, said head assembly 108 can comprise said head 902, said fill ring 904, said reinforcement ring 906, said coupling 908 and said tripod support 910.

In one embodiment, a portion of said slurry mixture 114 can be collected in said head assembly 108 and passed through said fill ring 904 into said coupling 908 and further into said shell assembly 104.

Figure 10:
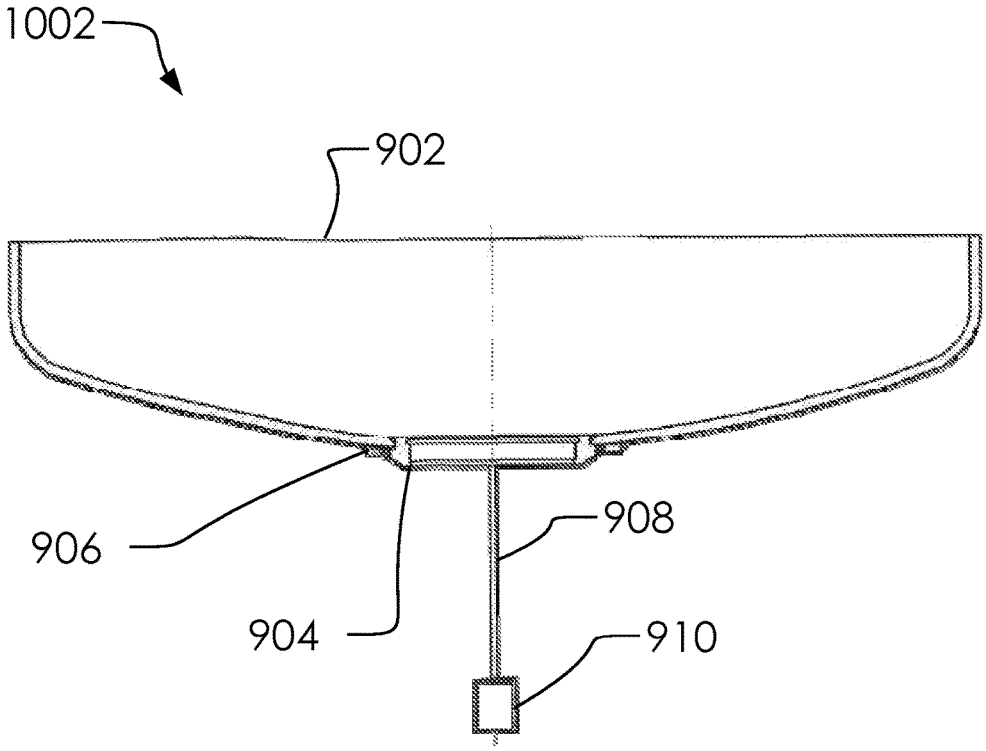
FIG. 10 illustrates an elevated front side view of a head assembly 108 at cross-section C-C.

FIG. 10 illustrates an elevated front side view of a head assembly 108 at cross-section C-C.

Figure 11A:
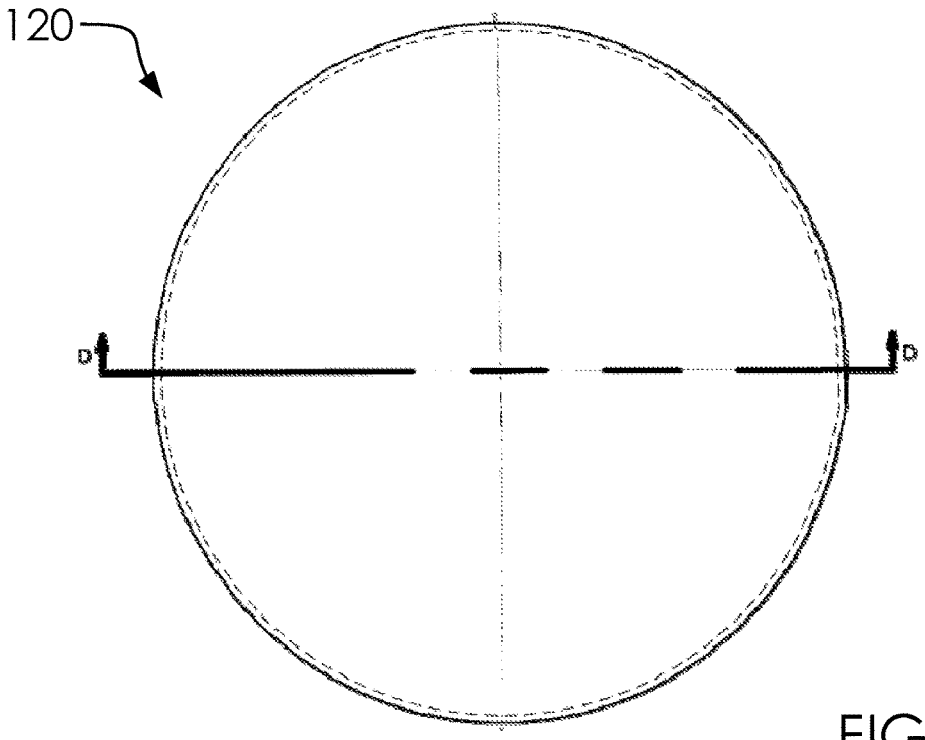
FIG. 11A illustrates an elevated top side view of a one or more head assemblies 120.

FIG. 11A illustrates an elevated top side view of a one or more head assemblies 120.

Figure 11B:
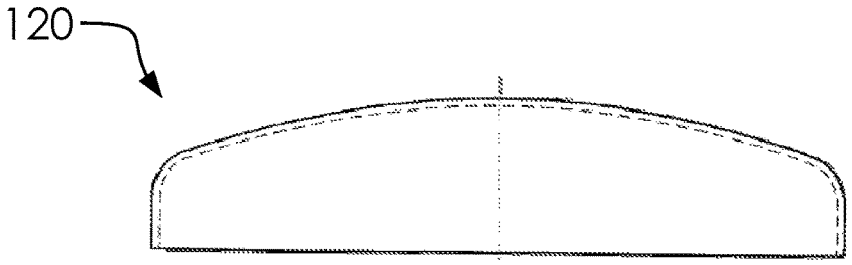
FIG. 11B illustrates an elevated front side view of a one or more head assemblies 120.

FIG. 11B illustrates an elevated front side view of a one or more head assemblies 120.

Figure 11C:
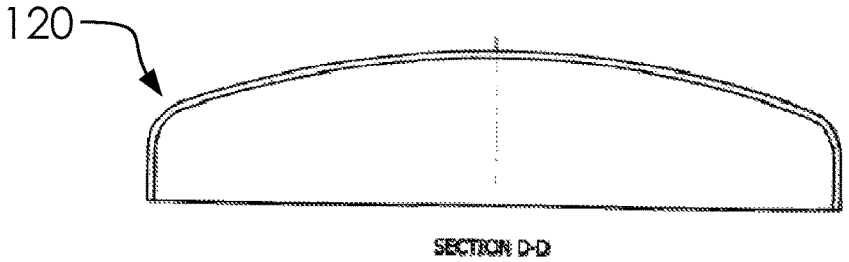
FIG. 11C illustrates an elevated front side view of a one or more head assemblies 120 at cross-section D-D.

FIG. 11C illustrates an elevated front side view of a one or more head assemblies 120 at cross-section D-D.

As illustrated, said one or more head assemblies 120 can comprise an embodiment without said one or more blister couplings 130 having been installed as yet.

In one embodiment, said one or more head assemblies 120 can be welded to said one or more shells 122; and said one or more shells 122 can be welded to said one or more cone assemblies 124.

Figure 12A:
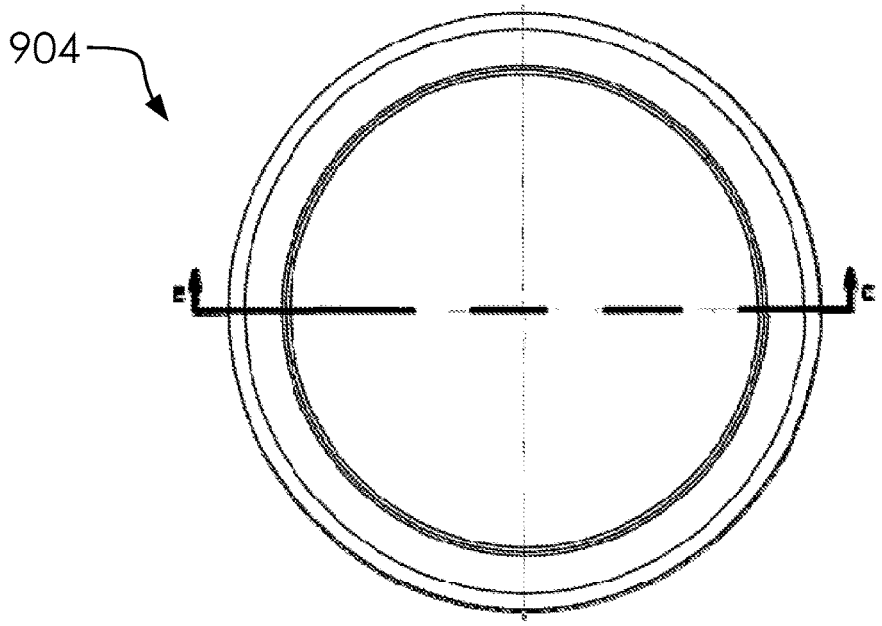
FIG. 12A illustrates an elevated top side view of a fill ring 904.

FIG. 12A illustrates an elevated top side view of a fill ring 904.

Figure 12B:
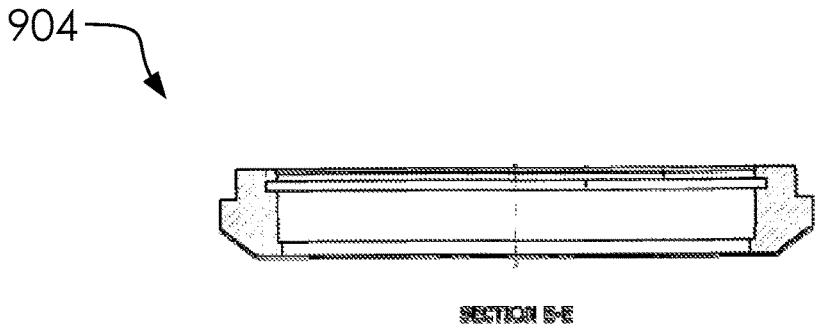
FIG. 12B illustrates an elevated front side view of a fill ring 904 with cross-section E-E.

FIG. 12B illustrates an elevated front side view of a fill ring 904 with cross-section E-E.

Figure 12C:
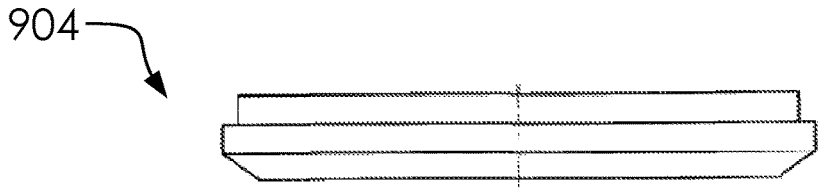
FIG. 12C illustrates an elevated front side view of a fill ring 904.

FIG. 12C illustrates an elevated front side view of a fill ring 904.

Figure 13A:
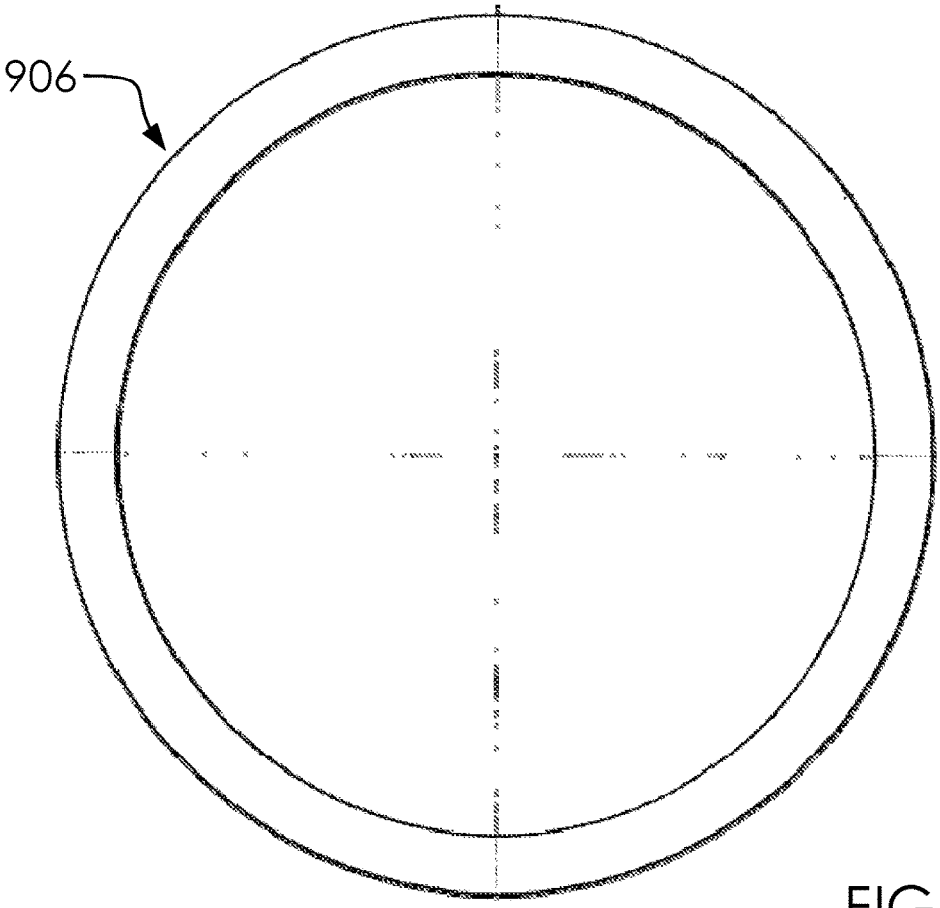
FIG. 13A illustrates an elevated top side view of a reinforcement ring 906.

FIG. 13A illustrates an elevated top side view of a reinforcement ring 906.

Figure 13B:
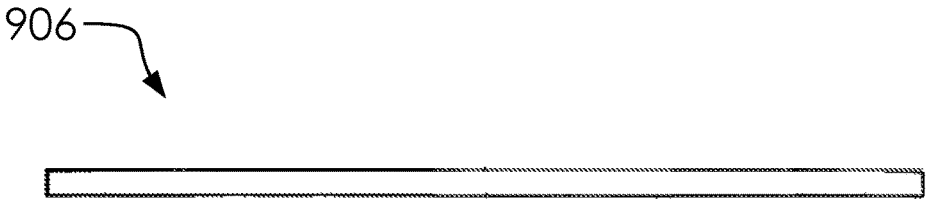
FIG. 13B illustrates an elevated front side view of a reinforcement ring 906.

FIG. 13B illustrates an elevated front side view of a reinforcement ring 906.

Figure 14A:
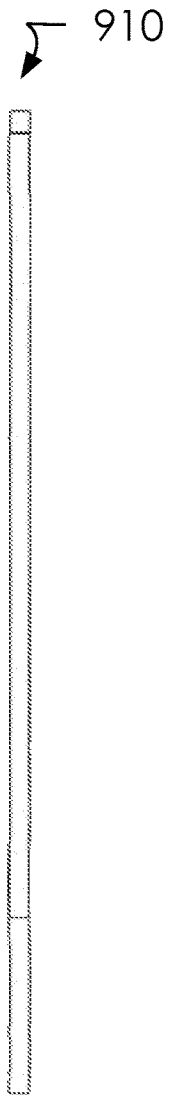
FIG. 14A illustrates an elevated first side view of a tripod support 910.

FIG. 14A illustrates an elevated first side view of a tripod support 910.

Figure 14B:
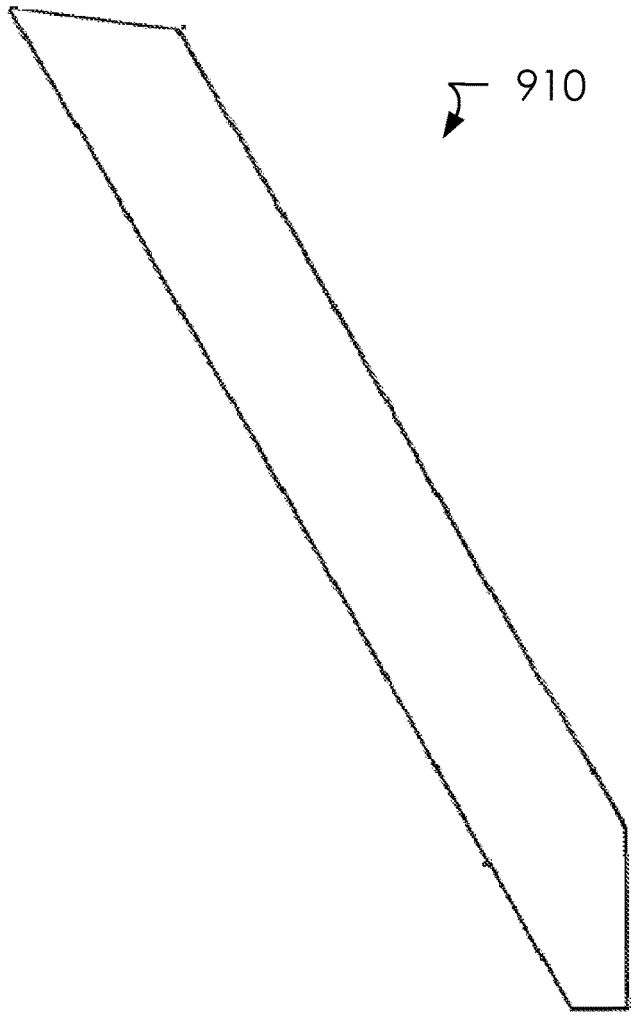
FIG. 14B illustrates an elevated front side view of a tripod support 910.

FIG. 14B illustrates an elevated front side view of a tripod support 910.

Figure 15A:
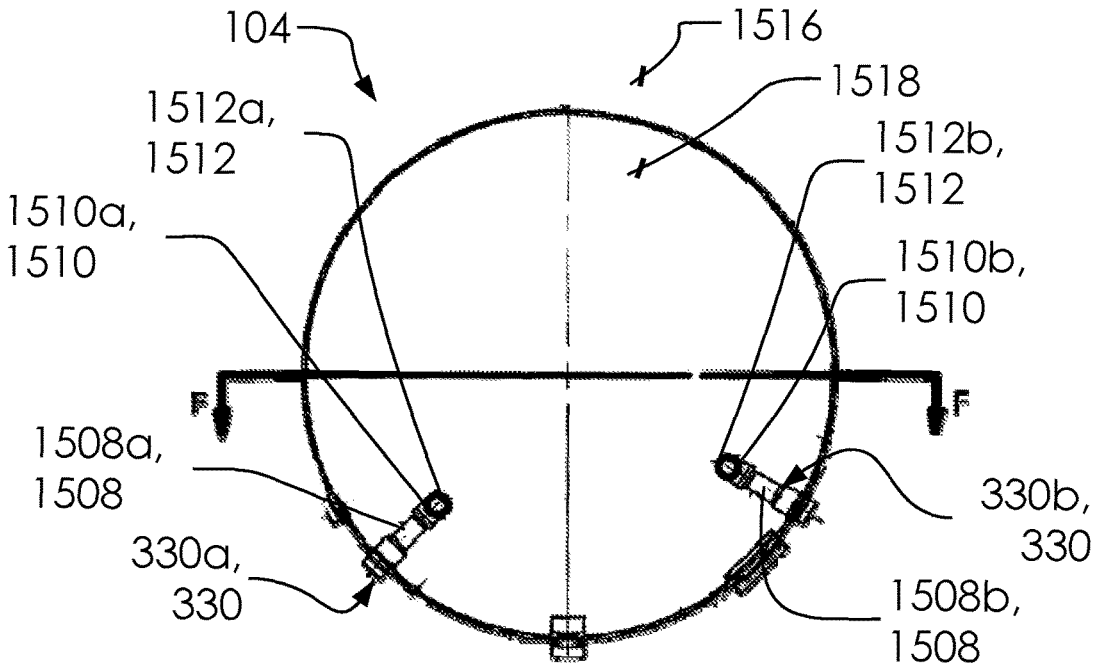
FIG. 15A illustrates an elevated top side view of a shell assembly 104.

FIG. 15A illustrates an elevated top side view of a shell assembly 104.

Figure 15B:
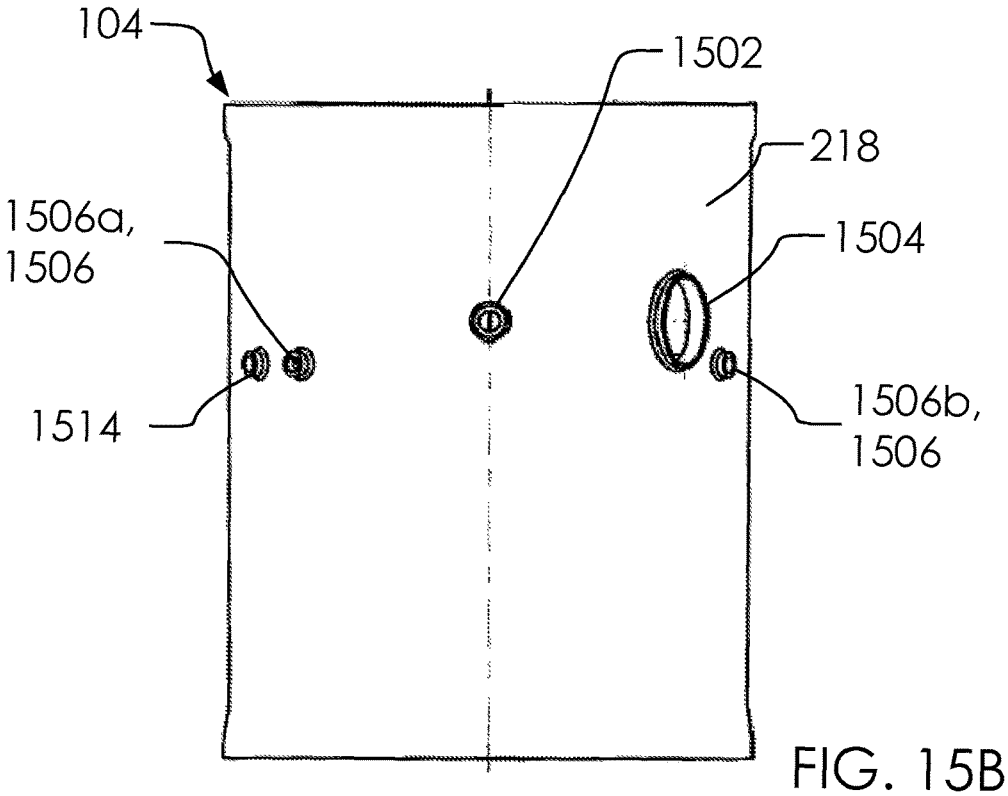
FIG. 15B illustrates an elevated front side view of a shell assembly 104.

FIG. 15B illustrates an elevated front side view of a shell assembly 104.

In one embodiment, said one or more threaded couplings 1506 can comprise said first threaded coupling 1506*a* and said second threaded coupling 1506*b*.

In one embodiment, said one or more elbow 1510 can comprise said first elbow 1510*a* and said second elbow 1510*b*.

In one embodiment, said one or more pipe 1512 can comprise said first pipe 1512*a* and said second pipe 1512*b*.

In one embodiment, said tank assembly 100 can comprise said interior volume 1516 and said exterior environment 1518.

In one embodiment, said one or more snorkel assemblies 330 can comprise said one or more threaded couplings 1506, said one or more nipples 1508, said one or more elbow 1510 and said one or more pipe 1512.

In one embodiment, said first snorkel assembly 330*a* can comprise said first threaded coupling 1506*a*, said first nipple 1508*a*, said first elbow 1510*a* and said first pipe 1512*a*.

In one embodiment, said second snorkel assembly 330*b* can comprise said second threaded coupling 1506*b*, said second nipple 1508*b*, said second elbow 1510*b* and said second pipe 1512*b*.

In one embodiment, said one or more snorkel assemblies 330 can enter in said outer body 218 and turn up toward an upper portion of said shell assembly 104 so as to maximize the likelihood of being above said slurry mixture 114 within said shell assembly 104.

In one embodiment, said hand hole rings 1504 can comprise a location for a user to access into said exterior environment 1518.

Figure 16A:
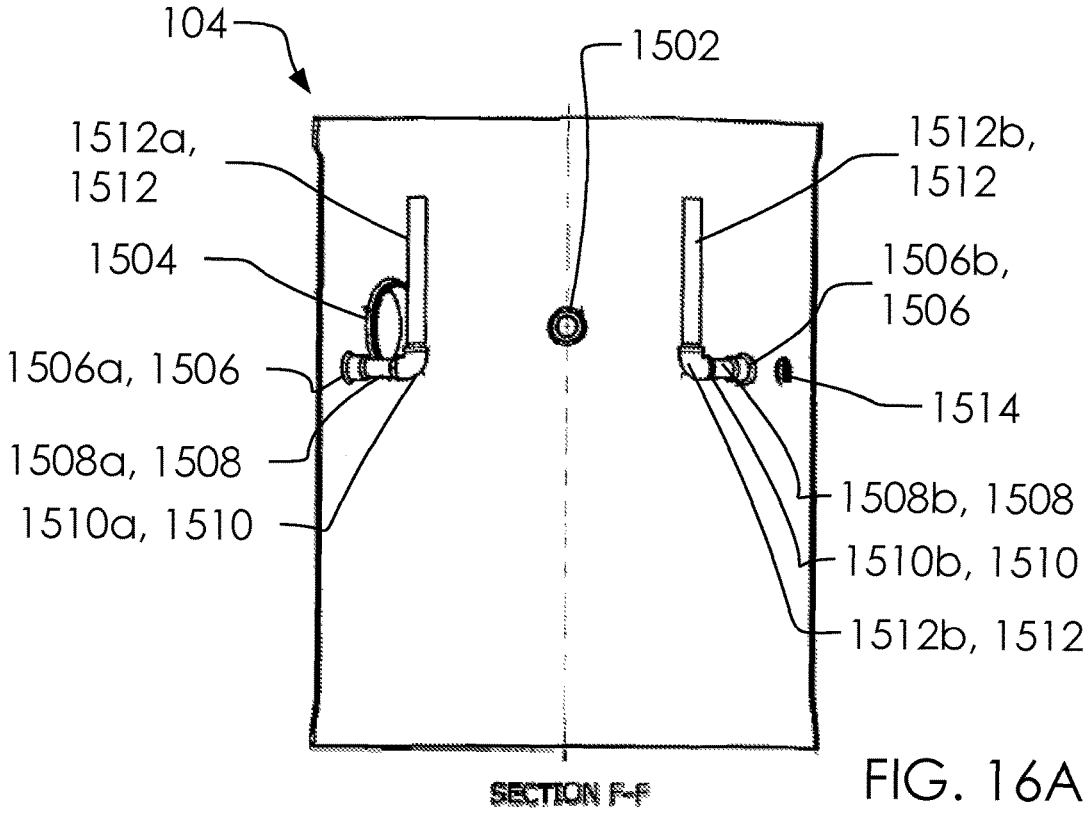
FIG. 16A illustrates an elevated front side view of a shell assembly 104 with cross-section F-F.

FIG. 16A illustrates an elevated front side view of a shell assembly 104 with cross-section F-F.

Figure 16B:
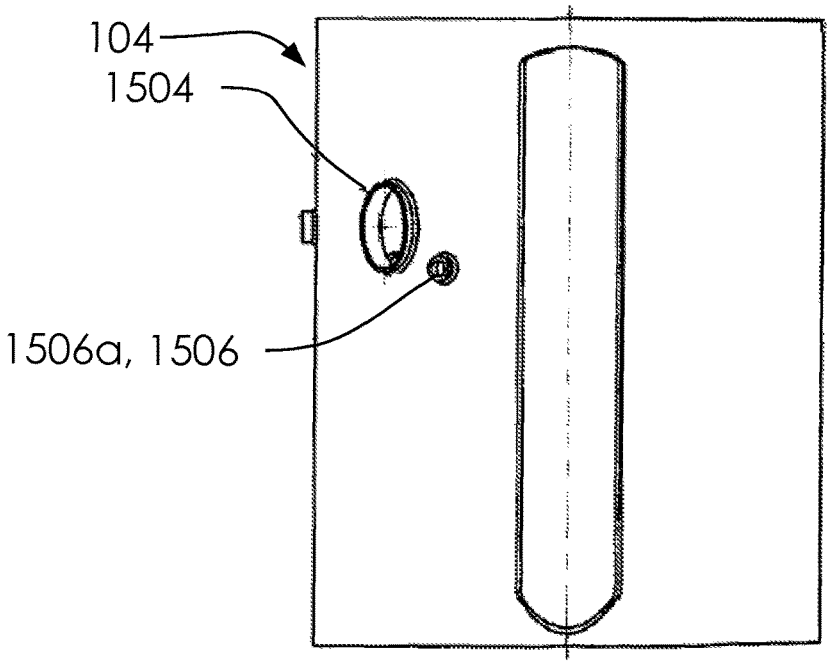
FIG. 16B illustrates an elevated first side view of a shell assembly 104.

FIG. 16B illustrates an elevated first side view of a shell assembly 104.

FIG. 17A illustrates an elevated top side view of a hand hole rings 1504.

FIG. 17B illustrates an elevated front side view of a hand hole rings 1504.

FIG. 17C illustrates an elevated first side view of a hand hole rings 1504.

Figure 18A:
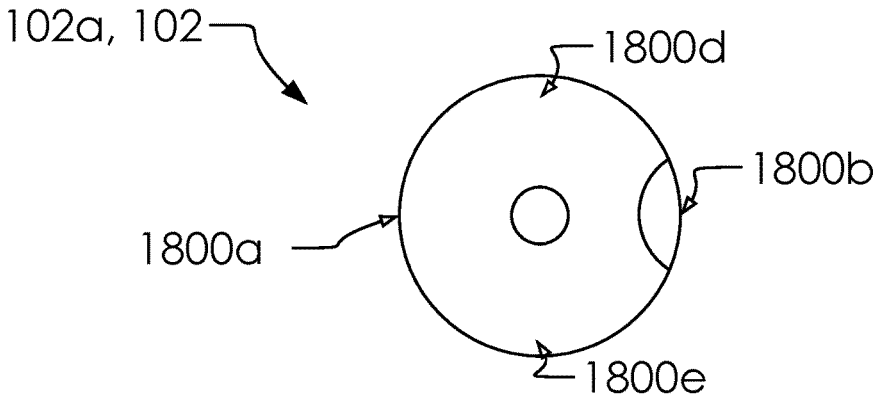
FIG. 18A illustrates an elevated top side view of a first blister assembly 102*a*.

FIG. 18A illustrates an elevated top side view of a first blister assembly 102*a*.

Figure 18B:
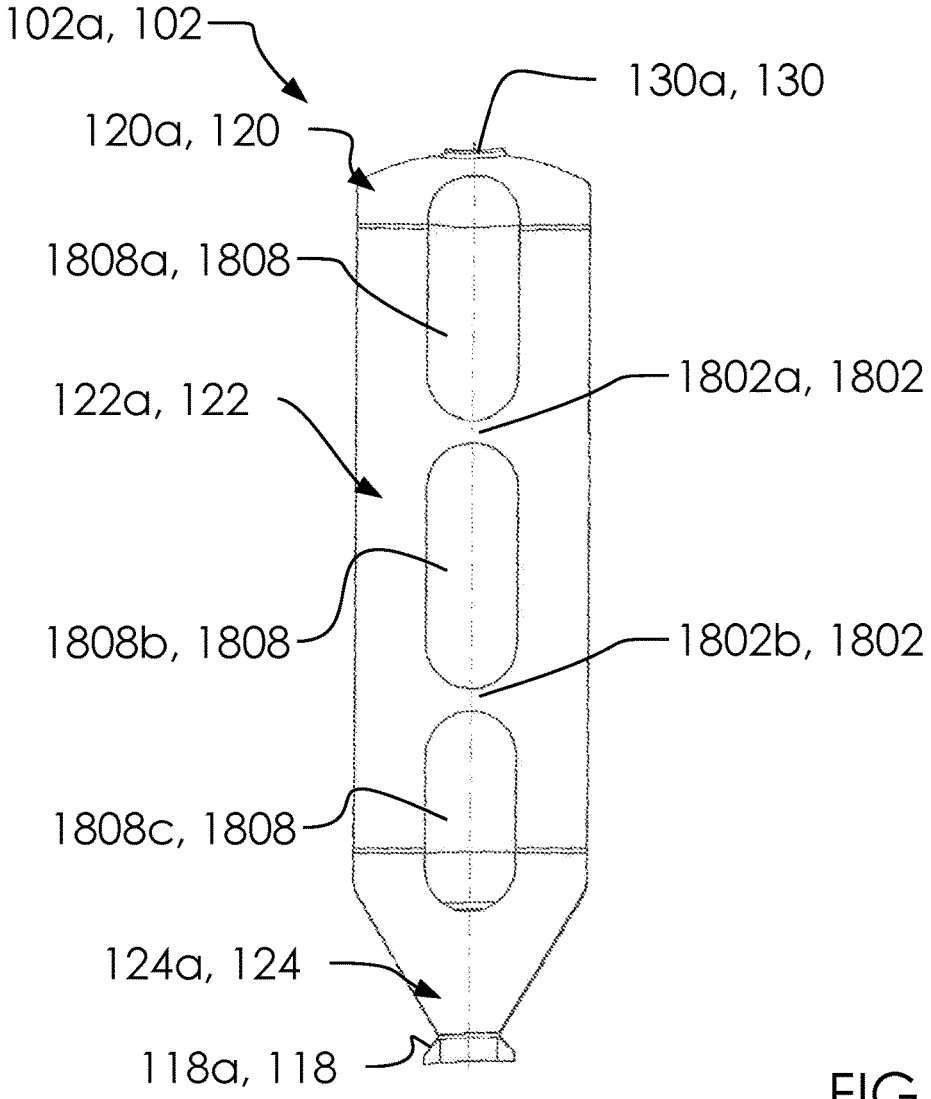
FIG. 18B illustrates an elevated second side view of a first blister assembly 102*a*.

FIG. 18B illustrates an elevated second side view of a first blister assembly 102*a*.

In one embodiment, said one or more bridges 1802 can comprise said first bridge 1802*a* and said second bridge 1802*b*.

In one embodiment, said one or more blister assemblies 102 can comprise said first side 1800*a*, said second side 1800*b*, said front side 1800*c*, said back side 1800*d*, said back side 1800*d*, said one or more bridges 1802, said first bridge 1802*a*, said second bridge 1802*b* and said second bridge 1802*b*.

In one embodiment, said first blister assembly 102*a* can comprise said one or more bridges 1802, said first bridge 1802*a* and said second bridge 1802*b*.

As noted above, said one or more blister assemblies 102 can comprise said one or more head assemblies 120, said one or more shells 122, said one or more cone assemblies 124, said one or more cone flanges 118, said one or more bridges 1802, and said one or more blister couplings 130. Said one or more blister couplings 130 can allow a portion of said one or more draw tubes 116 to pass through said one or more head assemblies 120.

Said one or more bridges 1802 can protect and reinforce said one or more shells 122 at said second side 1800*b*.

Figure 19A:
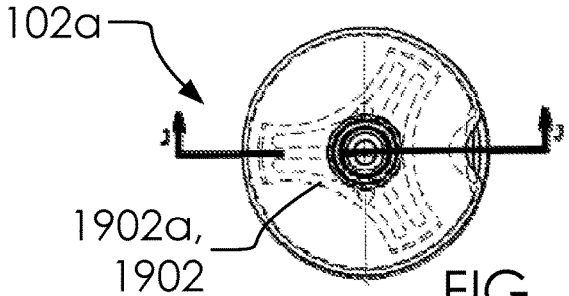
FIG. 19A illustrates an elevated top side view of a first blister assembly 102*a* with underlying structure in dashed line.

FIG. 19A illustrates an elevated top side view of a first blister assembly 102*a* with underlying structure in dashed line.

Figure 19B:
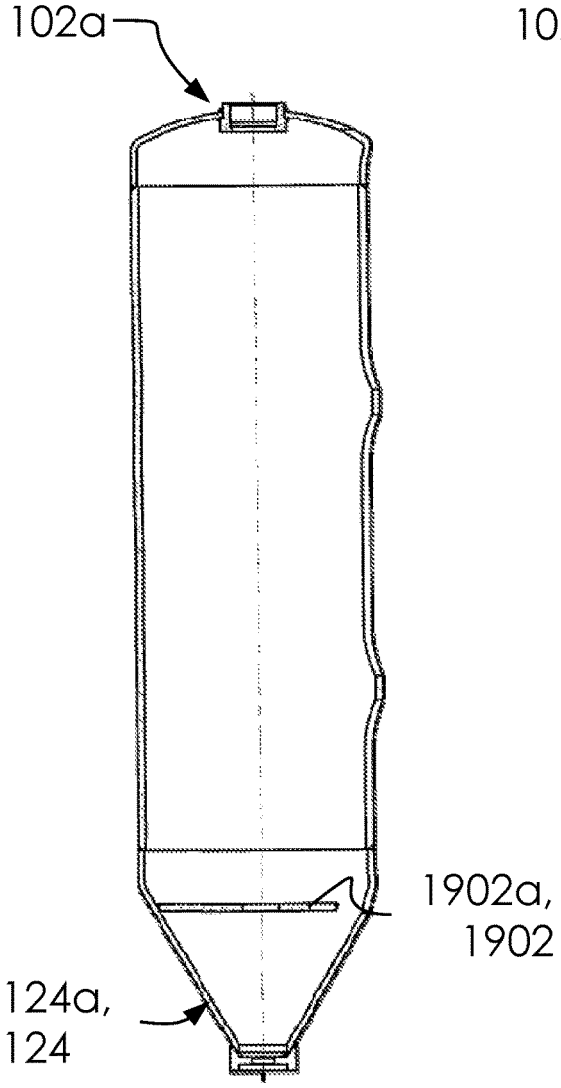
FIG. 19B illustrates an elevated front side view of a first blister assembly 102*a* with cross-section J-J.

FIG. 19B illustrates an elevated front side view of a first blister assembly 102*a* with cross-section J-J.

Figure 19C:
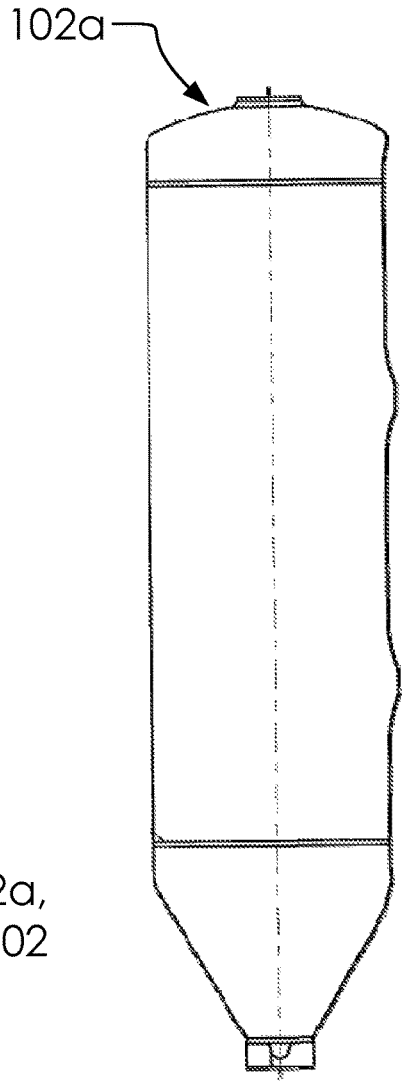
FIG. 19C illustrates an elevated first side view of a first blister assembly 102*a*.

FIG. 19C illustrates an elevated first side view of a first blister assembly 102*a*.

In one embodiment, said one or more spider guides 1902 can comprise said first spider guide 1902*a* and said second spider guide 1902*b*.

In one embodiment, said first blister assembly 102*a* can comprise said first spider guide 1902*a*.

In one embodiment, said second blister assembly 102*b* can comprise said second spider guide 1902*b*.

Figure 20A:
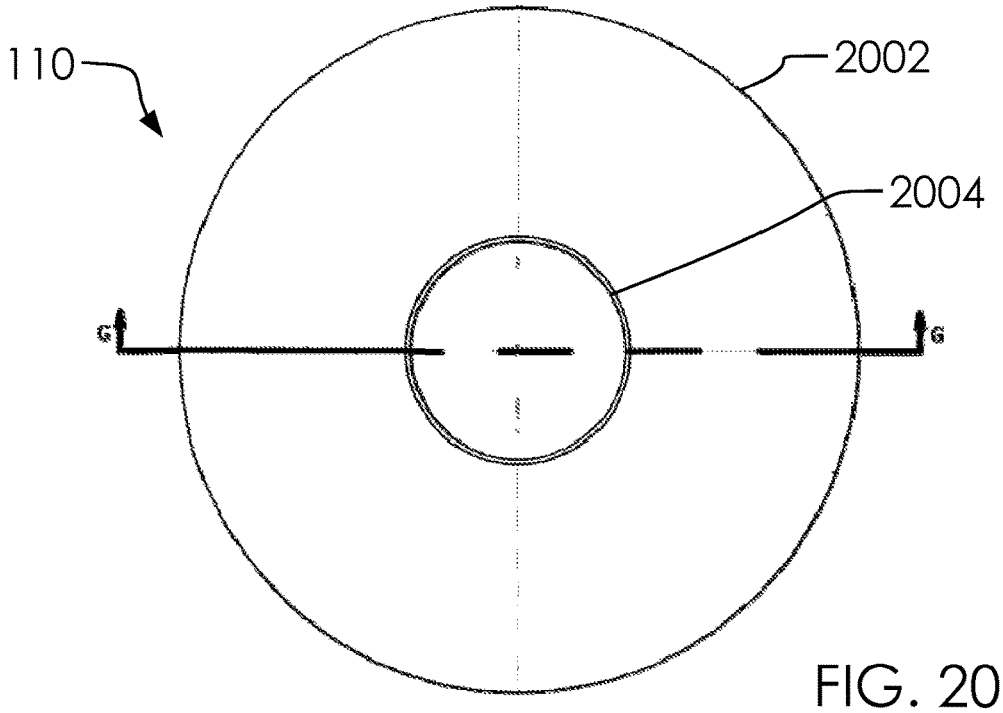
FIG. 20A illustrates an elevated top side view of a cone assembly 110.

FIG. 20A illustrates an elevated top side view of a cone assembly 110.

Figure 20B:
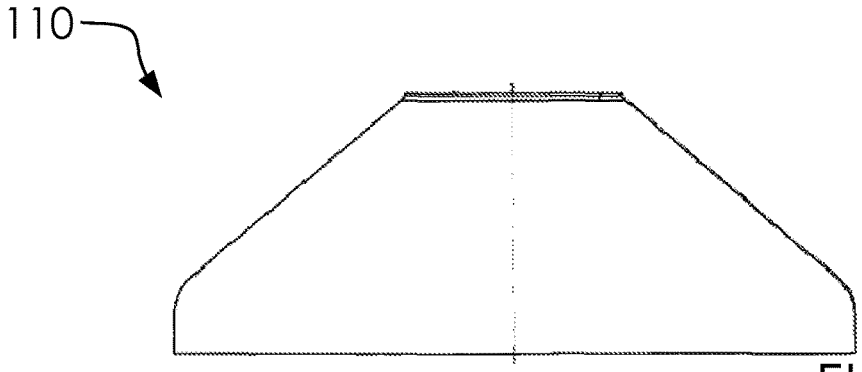
FIG. 20B illustrates an elevated front side view of a cone assembly 110.

FIG. 20B illustrates an elevated front side view of a cone assembly 110.

Figure 20C:
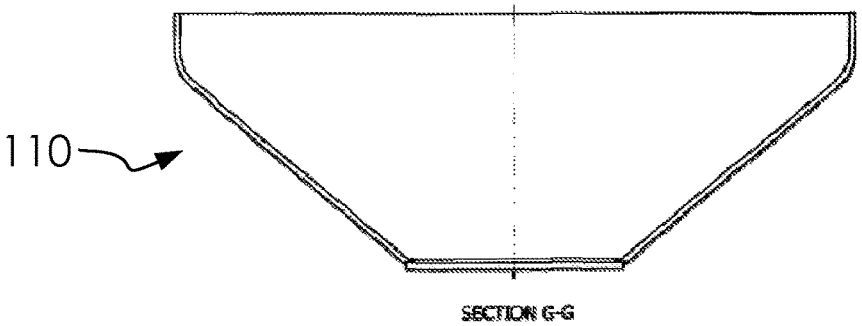
FIG. 20C illustrates an elevated front side view of a cone assembly 110 with cross-section G-G.

FIG. 20C illustrates an elevated front side view of a cone assembly 110 with cross-section G-G.

In one embodiment, said cone assembly 110 can comprise said cone body 2002 and said cone cap plate 2004.

Figure 21A:
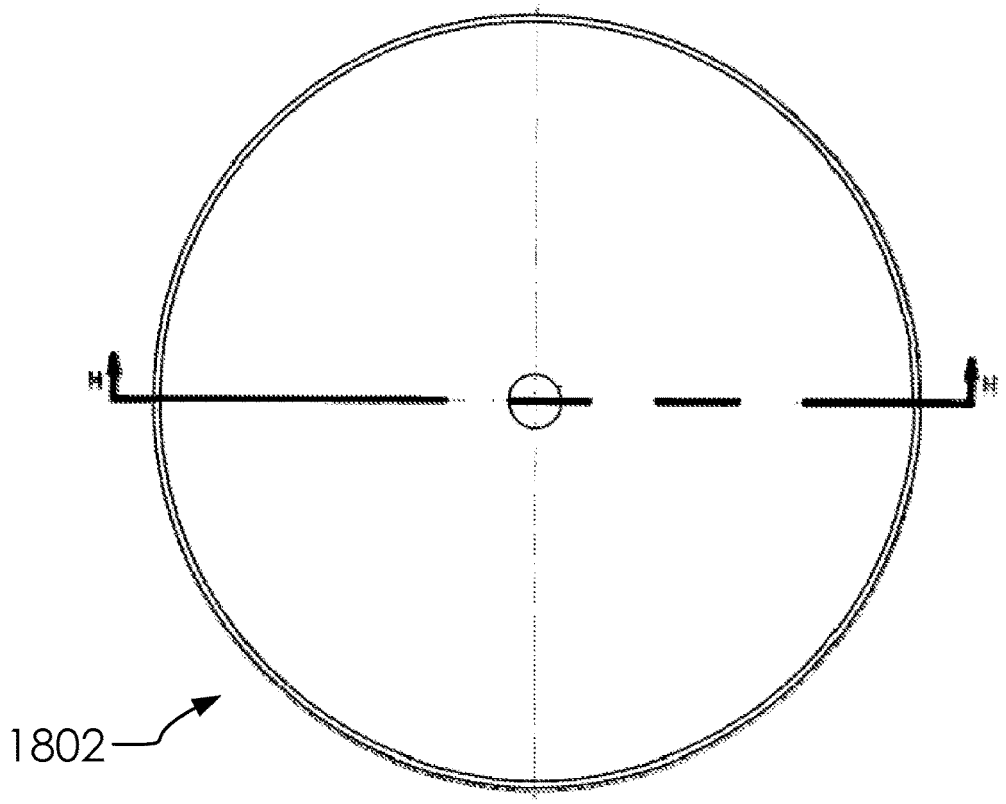
FIG. 21A illustrates an elevated top side view of a one or more bridges 1802.

FIG. 21A illustrates an elevated top side view of a one or more bridges 1802.

Figure 21B:
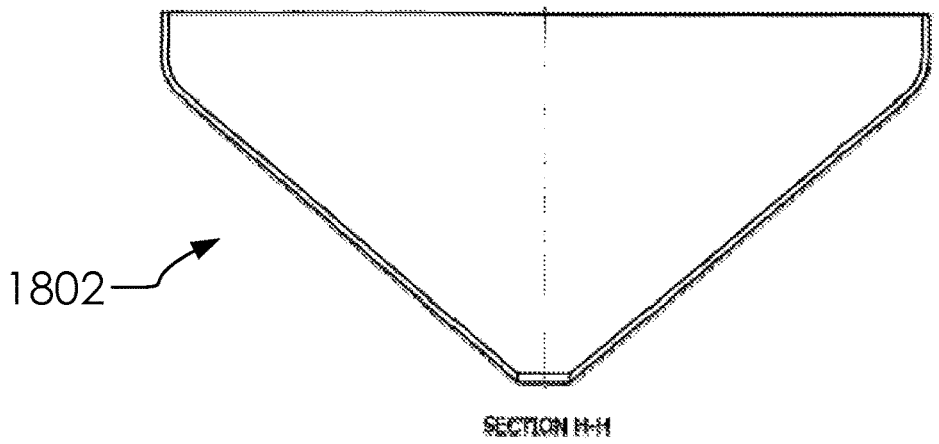
FIG. 21B illustrates an elevated front side view of a one or more bridges 1802 at cross-section H-H.

FIG. 21B illustrates an elevated front side view of a one or more bridges 1802 at cross-section H-H.

Figure 22A:
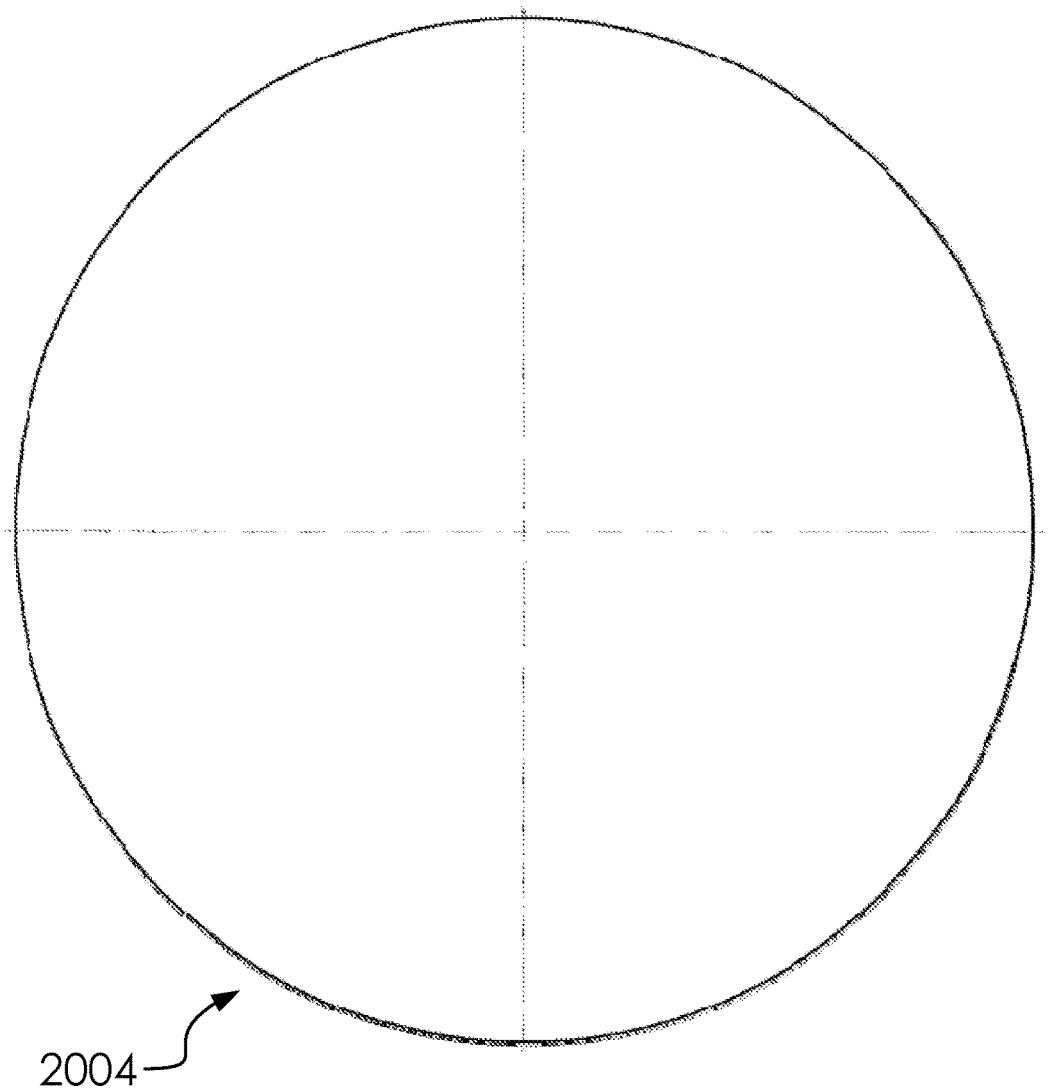
FIG. 22A illustrates an elevated top side view of a cone cap plate 2004.

FIG. 22A illustrates an elevated top side view of a cone cap plate 2004.

Figure 22B:
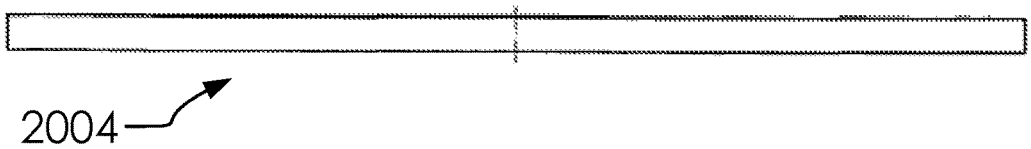
FIG. 22B illustrates an elevated front side view of a cone cap plate 2004.

FIG. 22B illustrates an elevated front side view of a cone cap plate 2004.

Figure 23A:
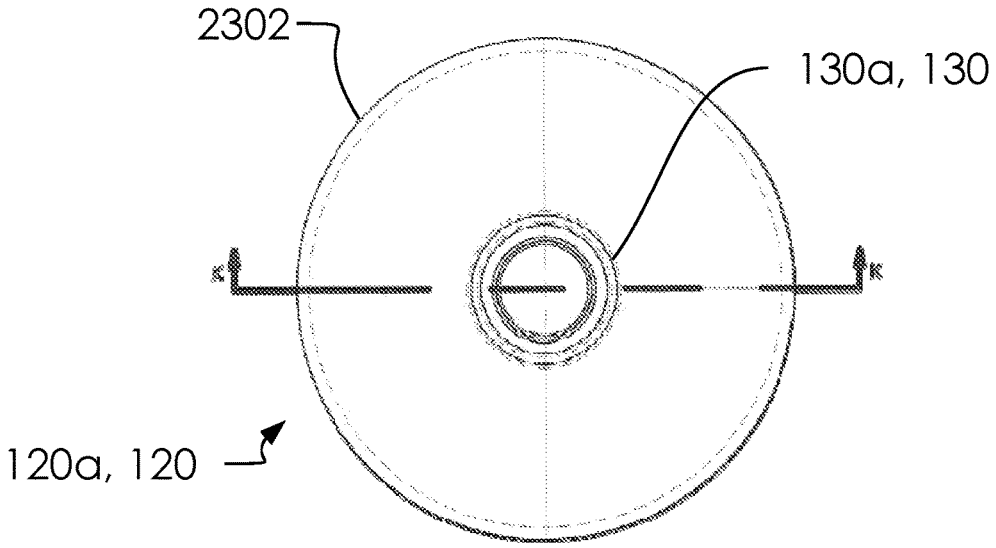
FIG. 23A illustrates an elevated top side view of a first head assembly 120*a*.

FIG. 23A illustrates an elevated top side view of a first head assembly 120*a*.

Figure 23B:
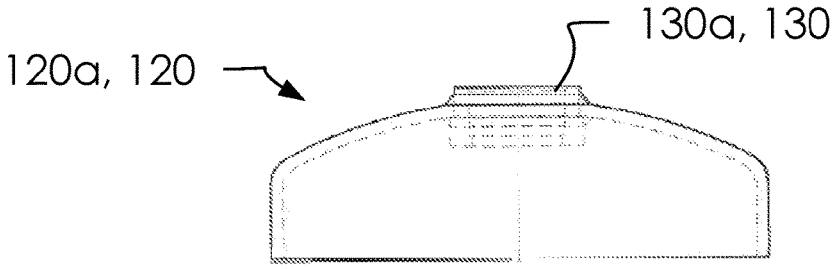
FIG. 23B illustrates an elevated front side view of a first head assembly 120*a*.

FIG. 23B illustrates an elevated front side view of a first head assembly 120*a*.

Figure 23C:
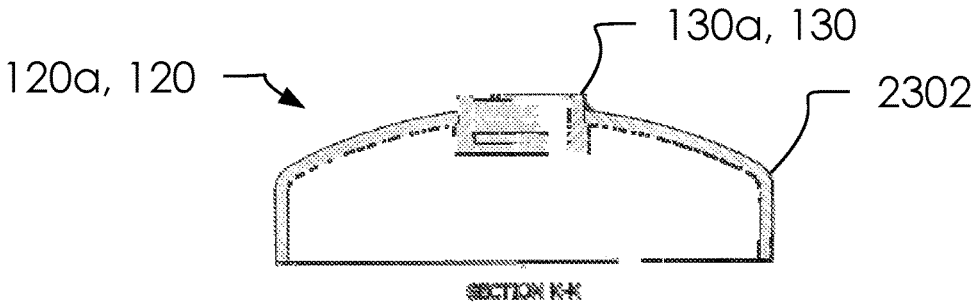
FIG. 23C illustrates an elevated front side view of a first head assembly 120*a* at cross-section K-K.

FIG. 23C illustrates an elevated front side view of a first head assembly 120*a* at cross-section K-K.

In one embodiment, said first head assembly 120*a* can comprise said blister head 2302 and said blister coupling 2304.

Figure 24A:
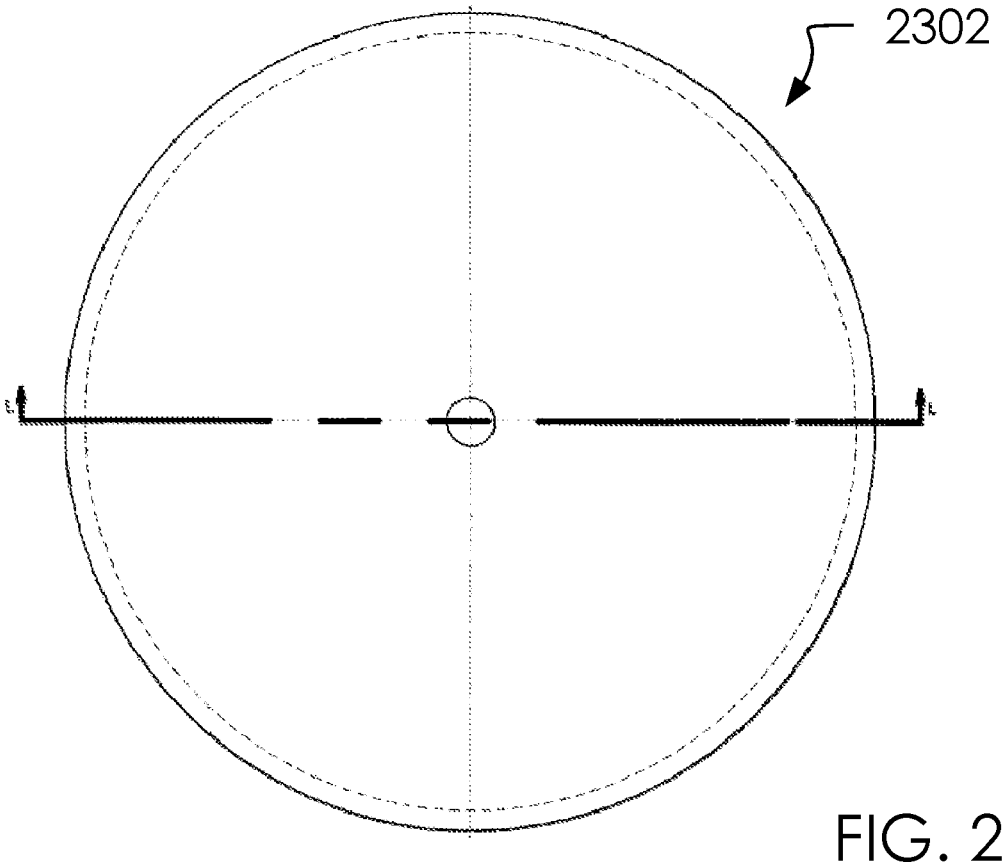
FIG. 24A illustrates an elevated top side view of a blister head 2302.

FIG. 24A illustrates an elevated top side view of a blister head 2302.

Figure 24B:
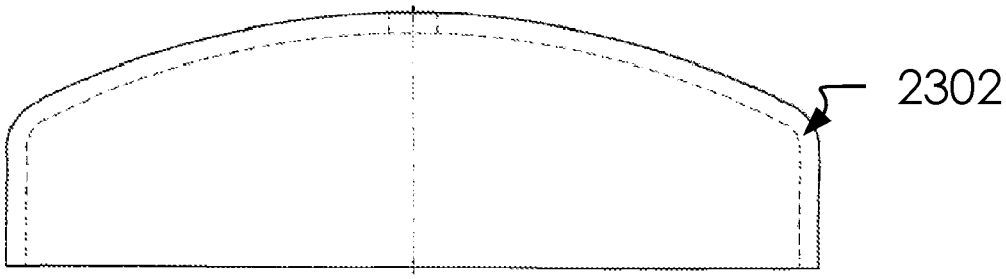
FIG. 24B illustrates an elevated front side view of a blister head 2302.

FIG. 24B illustrates an elevated front side view of a blister head 2302.

Figure 24C:
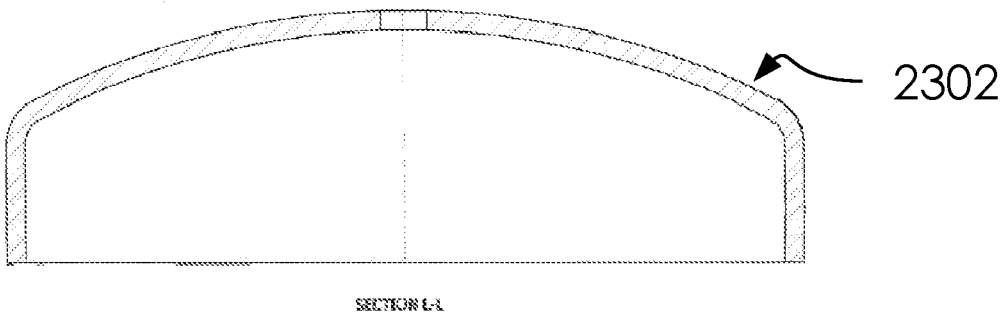
FIG. 24C illustrates an elevated front side view of a blister head 2302 with cross-section L-L.

FIG. 24C illustrates an elevated front side view of a blister head 2302 with cross-section L-L.

Figure 25A:
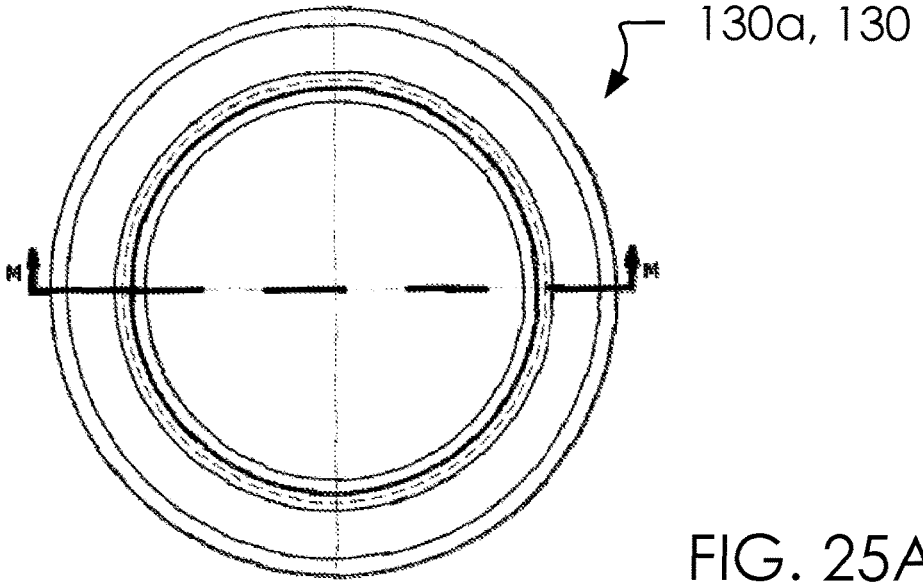
FIG. 25A illustrates an elevated top side view of a first blister coupling 130*a*.

FIG. 25A illustrates an elevated top side view of a first blister coupling 130*a*.

Figure 25B:
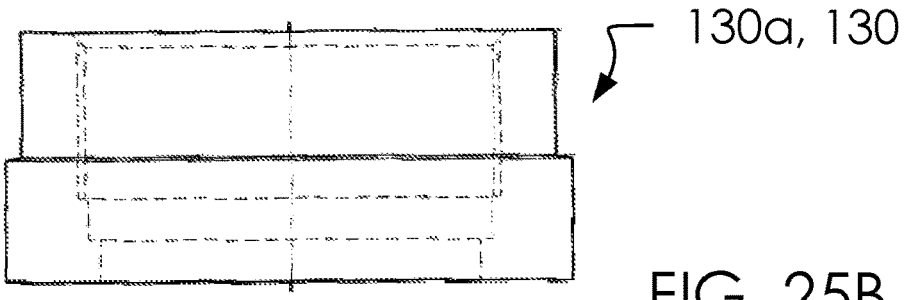
FIG. 25B illustrates an elevated front side view of a first blister coupling 130*a*.

FIG. 25B illustrates an elevated front side view of a first blister coupling 130*a*.

Figure 25C:
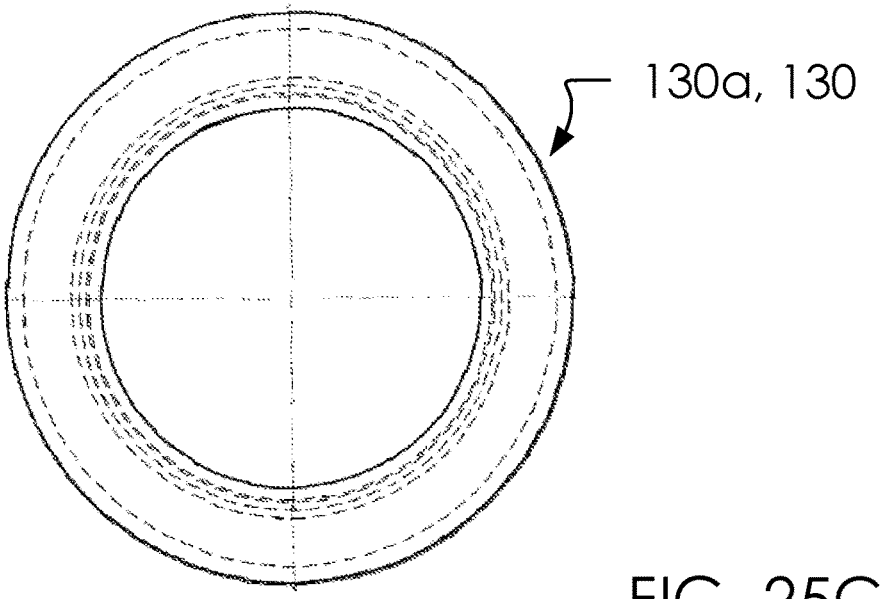
FIG. 25C illustrates an elevated bottom side view of a first blister coupling 130*a*.

FIG. 25C illustrates an elevated bottom side view of a first blister coupling 130*a*.

Figure 26A:
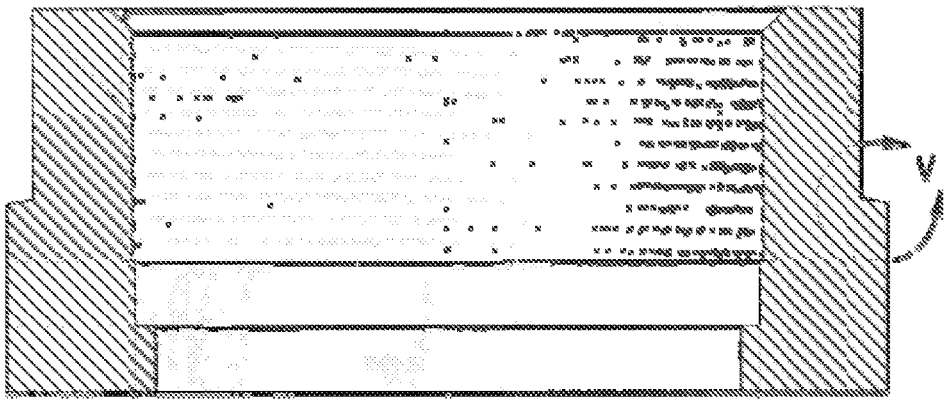
FIG. 26A illustrates an elevated bottom side view of a first blister coupling 130*a* with cross-section M-M.

FIG. 26A illustrates an elevated bottom side view of a first blister coupling 130*a* with cross-section M-M.

Figure 26B:
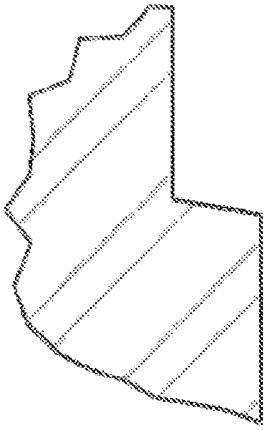
FIG. 26B illustrates an elevated bottom side view of a first blister coupling 130*a* with detailed view V.

FIG. 26B illustrates an elevated bottom side view of a first blister coupling 130*a* with detailed view V.

Figure 27A:
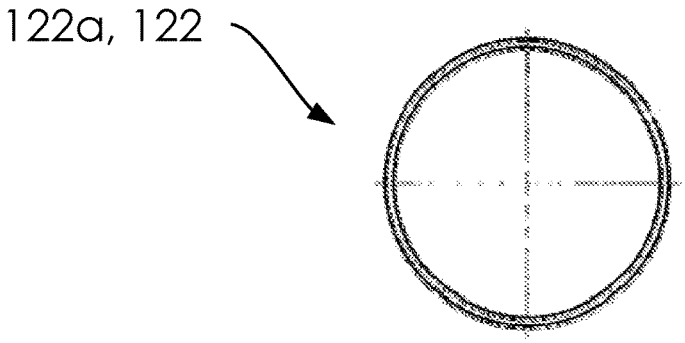
FIG. 27A illustrates an elevated top side view of a one or more shells 122.

FIG. 27A illustrates an elevated top side view of a one or more shells 122.

Figure 27B:
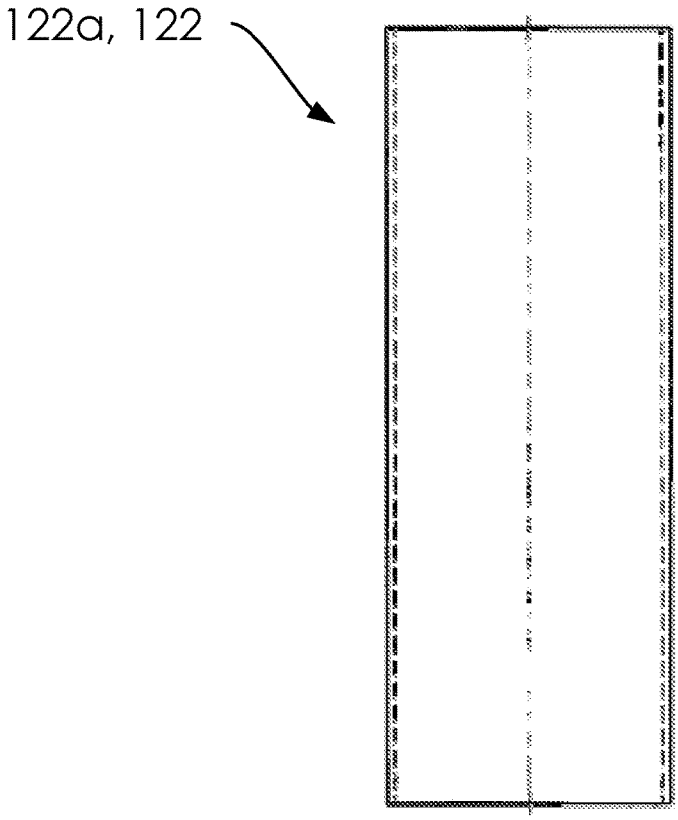
FIG. 27B illustrates an elevated front side view of a one or more shells 122.

FIG. 27B illustrates an elevated front side view of a one or more shells 122.

Figure 28:
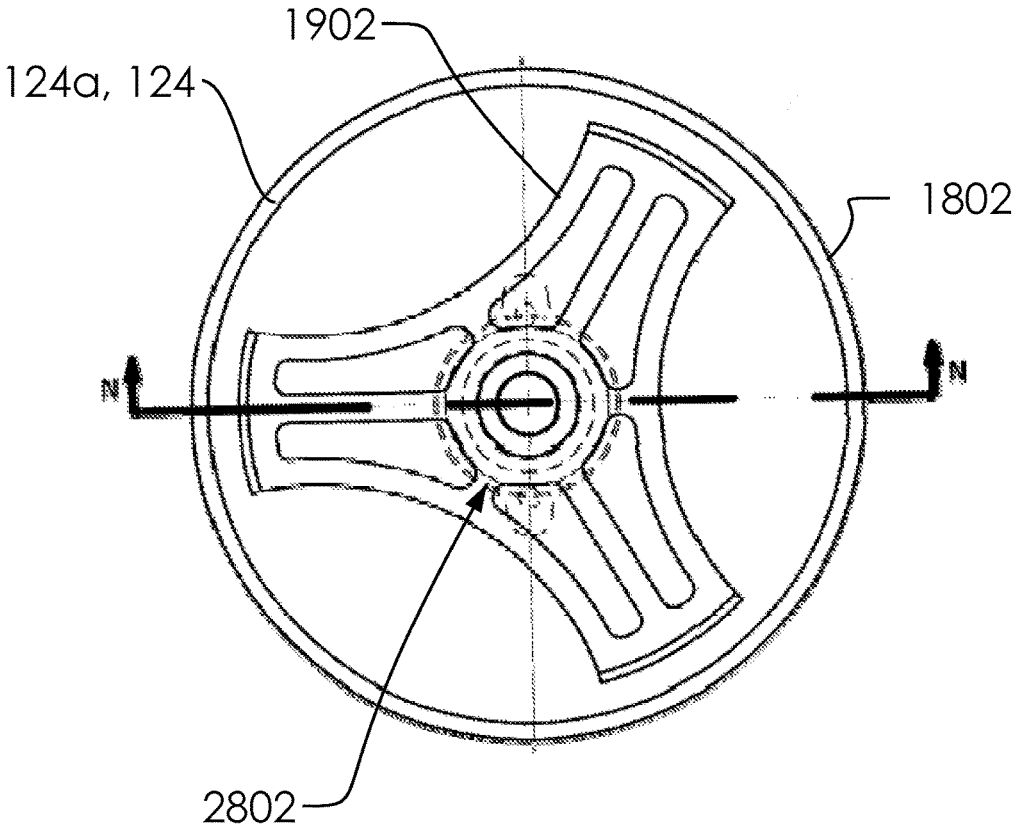
FIG. 28 illustrates an elevated top side view of a first cone assembly 124*a*.

FIG. 28 illustrates an elevated top side view of a first cone assembly 124*a*.

In one embodiment, said tank assembly 100 can comprise said cone flange 2802.

Figure 29A:
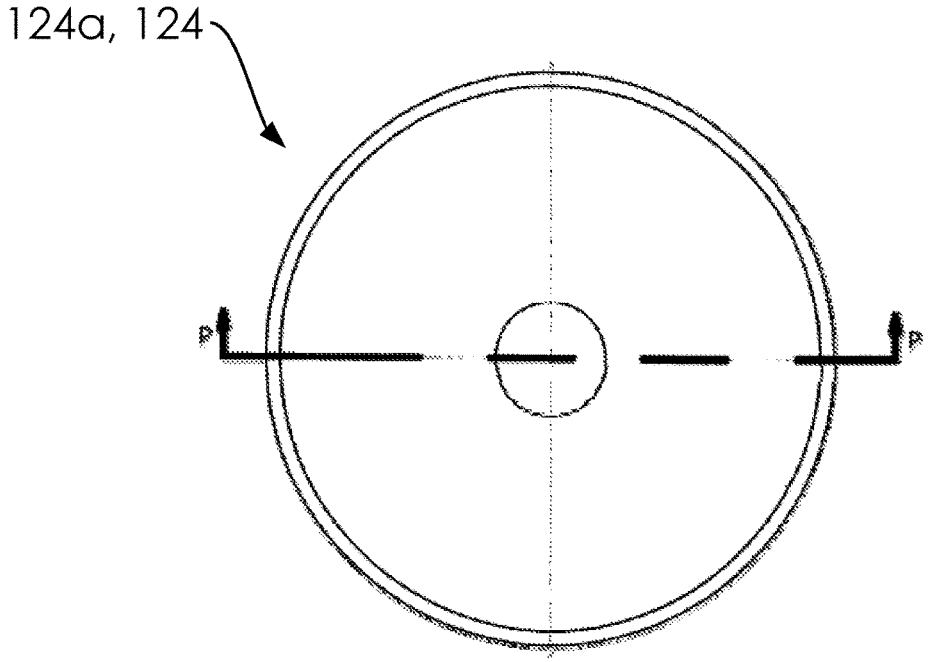
FIG. 29A illustrates an elevated top side view of a one or more cone assemblies 124.

FIG. 29A illustrates an elevated top side view of a one or more cone assemblies 124.

Figure 29B:
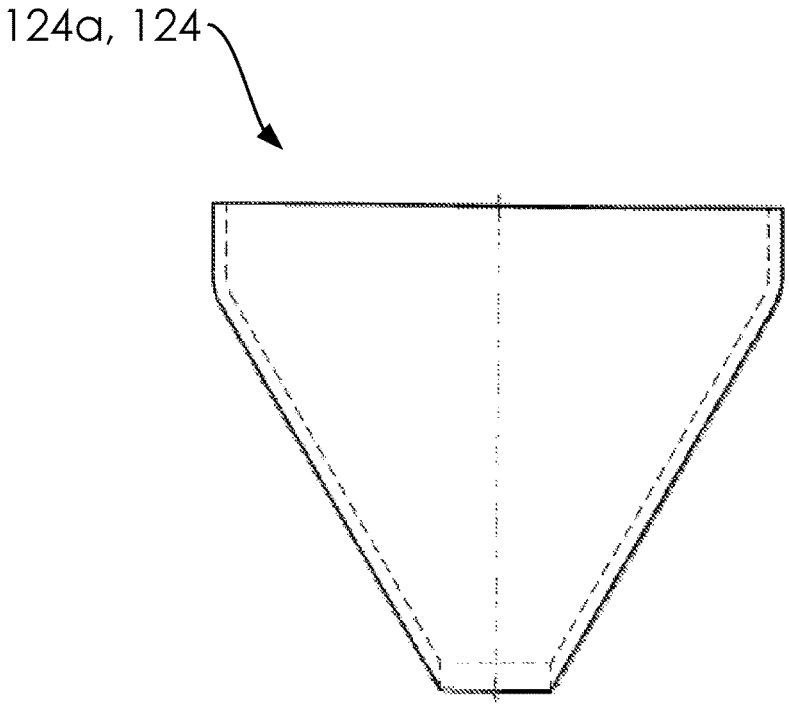
FIG. 29B illustrates an elevated front side view of a one or more cone assemblies 124.

FIG. 29B illustrates an elevated front side view of a one or more cone assemblies 124.

Figure 30A:
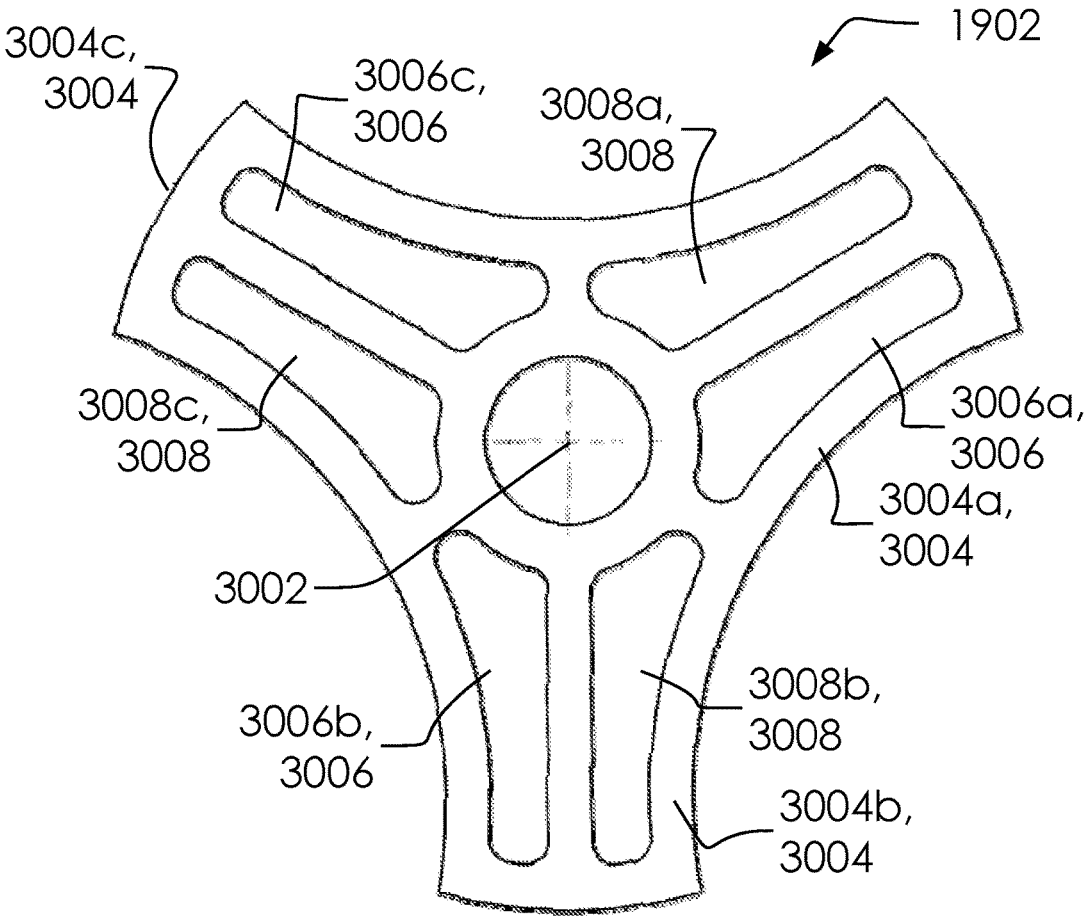
FIG. 30A illustrates an elevated top side view of a one or more spider guides 1902.

FIG. 30A illustrates an elevated top side view of a one or more spider guides 1902.

Figure 30B:
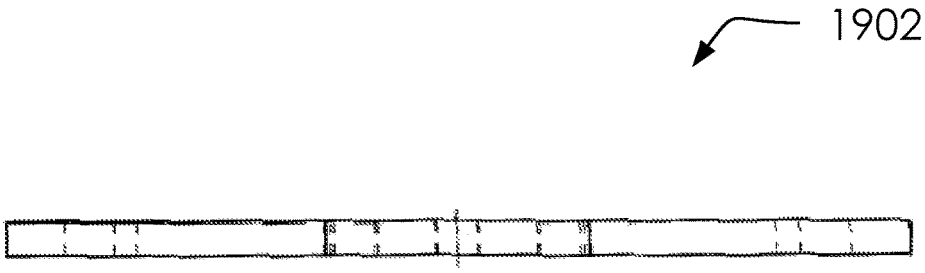
FIG. 30B illustrates an elevated front side view of a one or more spider guides 1902.

FIG. 30B illustrates an elevated front side view of a one or more spider guides 1902.

In one embodiment, said one or more extensions 3004 can comprise said first extension 3004*a*, said second extension 3004*b* and said third extension 3004*c*.

In one embodiment, said one or more right apertures 3006 can comprise said first right aperture 3006*a*, said second right aperture 3006*b* and said third right aperture 3006*c*.

In one embodiment, said one or more left apertures 3008 can comprise said first left aperture 3008*a*, said second left aperture 3008*b* and said third left aperture 3008*c*.

In one embodiment, said one or more spider guides 1902 can comprise said center aperture 3002, said one or more extensions 3004, said first extension 3004*a*, said second extension 3004*b*, said third extension 3004*c*, said one or more right apertures 3006, said first right aperture 3006*a*, said second right aperture 3006*b*, said third right aperture 3006*c*, said one or more left apertures 3008, said first left aperture 3008*a*, said second left aperture 3008*b* and said third left aperture 3008*c*.

In one embodiment, a portion of said one or more draw tubes 116 can pass through said center aperture 3002 so as to center and stabilize said one or more draw tubes 116 within said one or more blister assemblies 102. In one embodiment, said one or more right apertures 3006 and said one or more left apertures 3008 can allow portions of said slurry mixture 114 to pass freely below said one or more spider guides 1902. In one embodiment, said one or more spider guides 1902 can comprise a three points extending radially at 120 degree increments; namely said one or more extensions 3004, as illustrated. In one embodiment, said one or more extensions 3004 can press against an interior wall of said one or more blister assemblies 102.

Figure 31A:
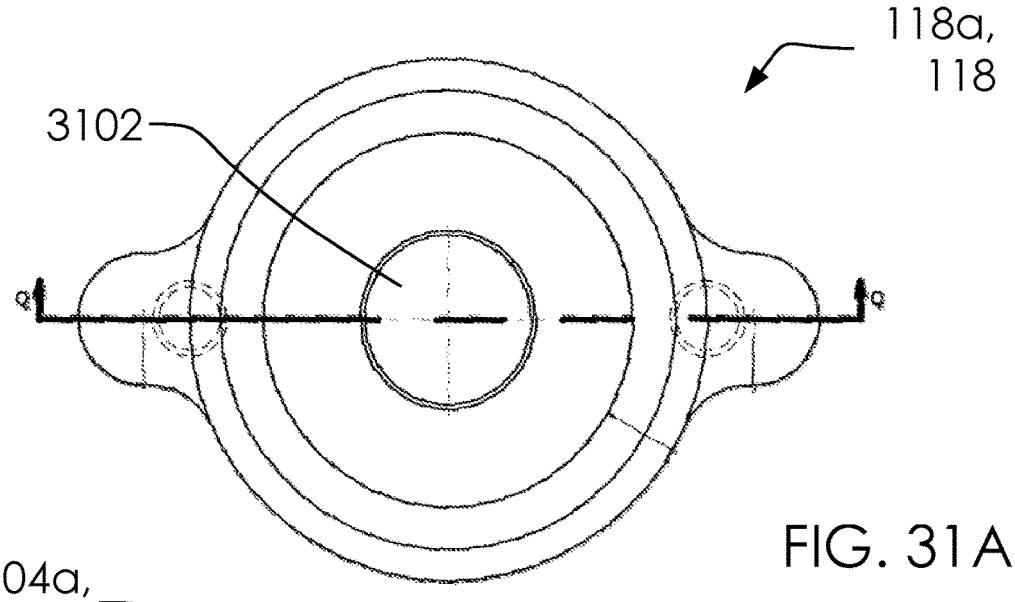
FIG. 31A illustrates an elevated top side view of a one or more cone flanges 118.

FIG. 31A illustrates an elevated top side view of a one or more cone flanges 118.

Figure 31B:
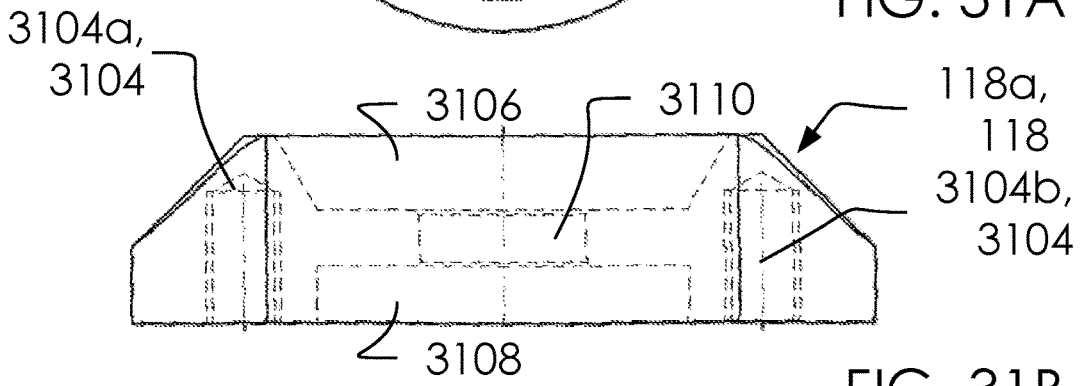
FIG. 31B illustrates an elevated front side view of a one or more cone flanges 118.

FIG. 31B illustrates an elevated front side view of a one or more cone flanges 118.

Figure 31C:
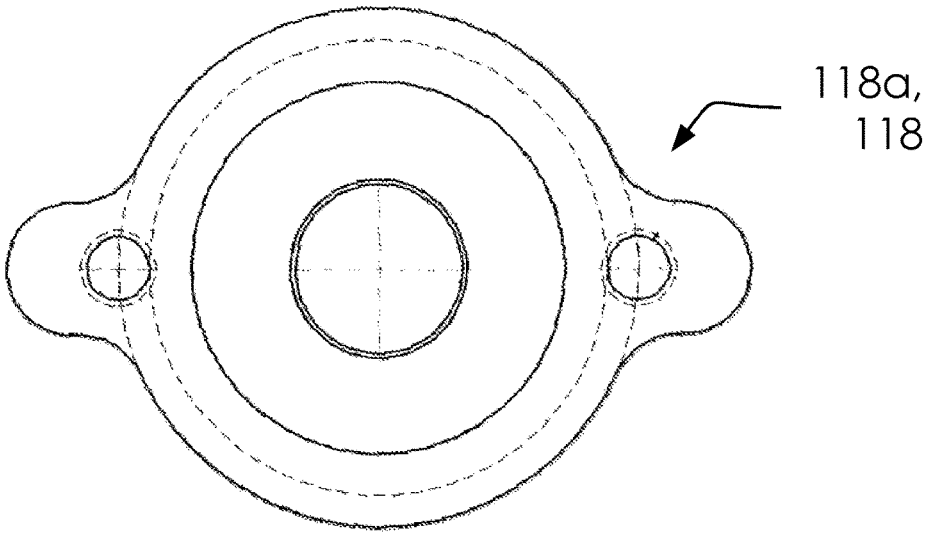
FIG. 31C illustrates an elevated bottom side view of a one or more cone flanges 118.

FIG. 31C illustrates an elevated bottom side view of a one or more cone flanges 118.

In one embodiment, said center aperture 3102 can comprise said upper fitting 3106, said lower fitting 3108 and said center gap 3110.

In one embodiment, said one or more threaded sockets 3104 can comprise said first threaded socket 3104*a* and said second threaded socket 3104*b*.

In one embodiment, said one or more cone flanges 118 can comprise said center aperture 3102, said center aperture 3102, said upper fitting 3106, said lower fitting 3108 and said center gap 3110.

Figure 32A:
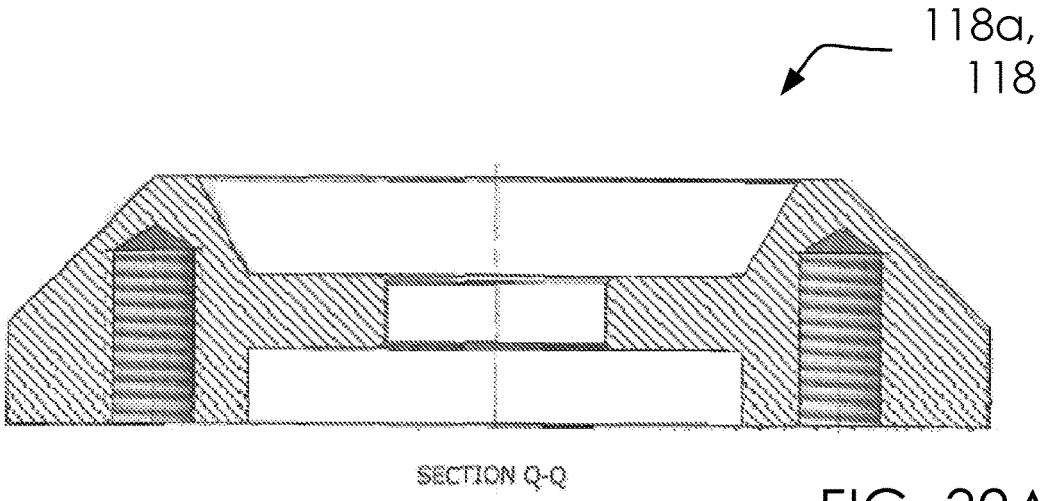
FIG. 32A illustrates an elevated front side view of a one or more cone flanges 118 at cross-section Q-Q.

FIG. 32A illustrates an elevated front side view of a one or more cone flanges 118 at cross-section Q-Q.

Figure 32B:
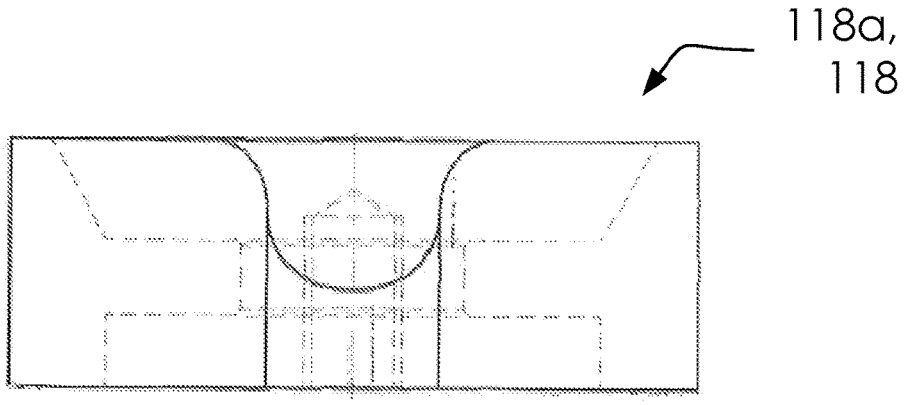
FIG. 32B illustrates an elevated first side view of a one or more cone flanges 118.

FIG. 32B illustrates an elevated first side view of a one or more cone flanges 118.

Figure 33A:
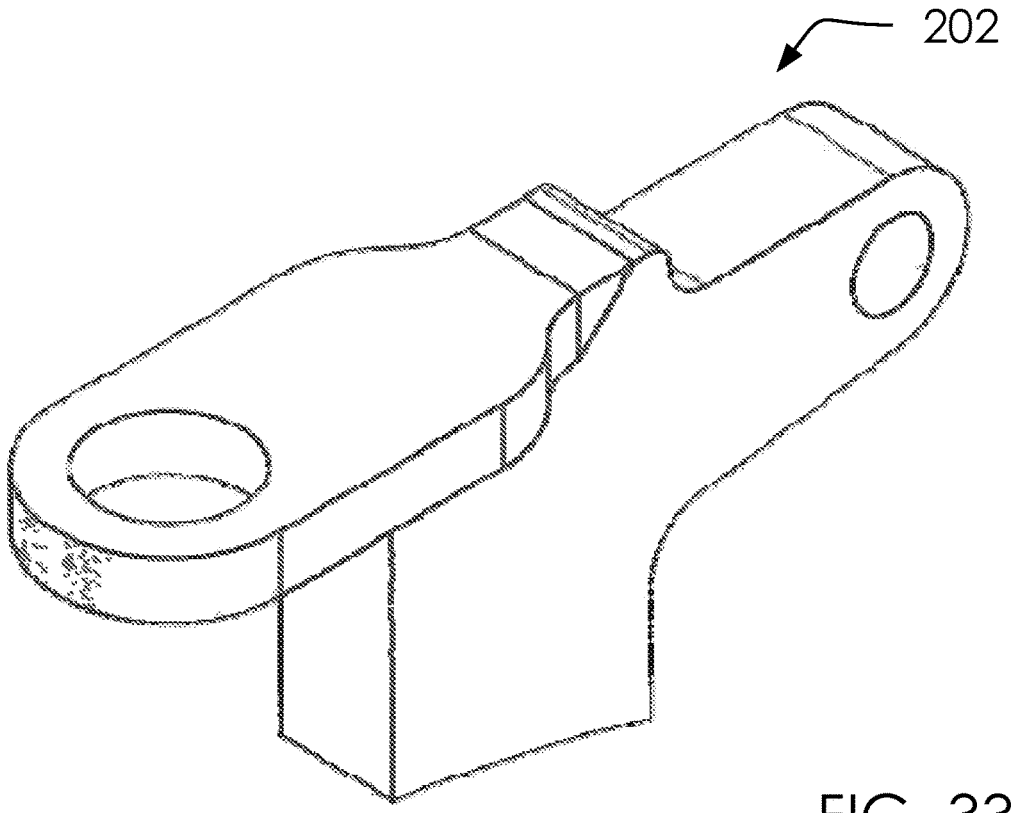
FIG. 33A illustrates a perspective front side view of a one or more rocker arm pedestals 202.

FIG. 33A illustrates a perspective front side view of a one or more rocker arm pedestals 202.

Figure 33B:
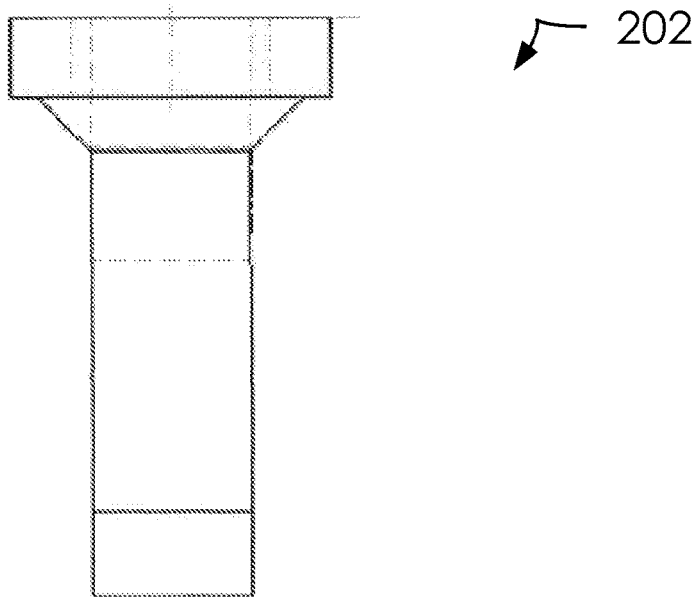
FIG. 33B illustrates an elevated front side view of a one or more rocker arm pedestals 202.

FIG. 33B illustrates an elevated front side view of a one or more rocker arm pedestals 202.

Figure 34A:
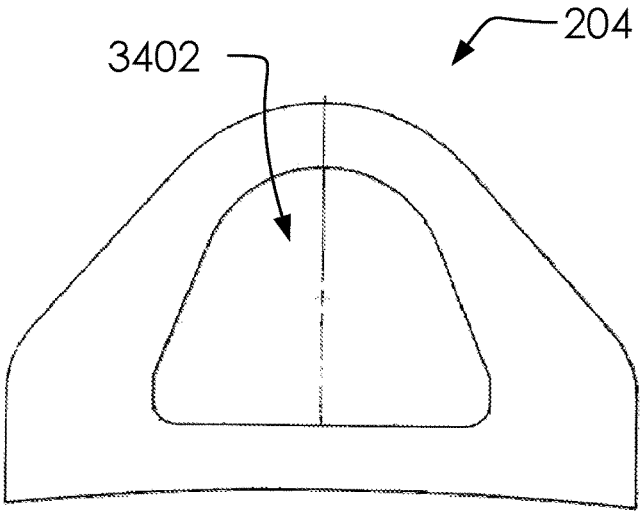
FIG. 34A illustrates an elevated front side view of a one or more hoisting lugs 204.

FIG. 34A illustrates an elevated front side view of a one or more hoisting lugs 204.

Figure 34B:
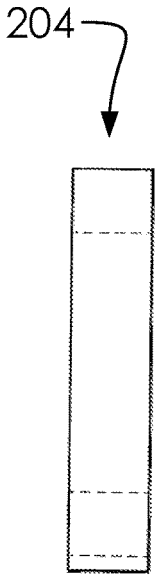
FIG. 34B illustrates an elevated first side view of a one or more hoisting lugs 204.

FIG. 34B illustrates an elevated first side view of a one or more hoisting lugs 204.

Figure 34C:
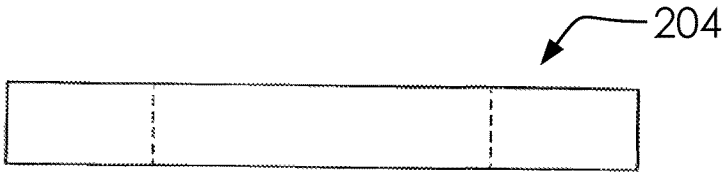
FIG. 34C illustrates an elevated top side view of a one or more hoisting lugs 204.

FIG. 34C illustrates an elevated top side view of a one or more hoisting lugs 204.

Figure 35:
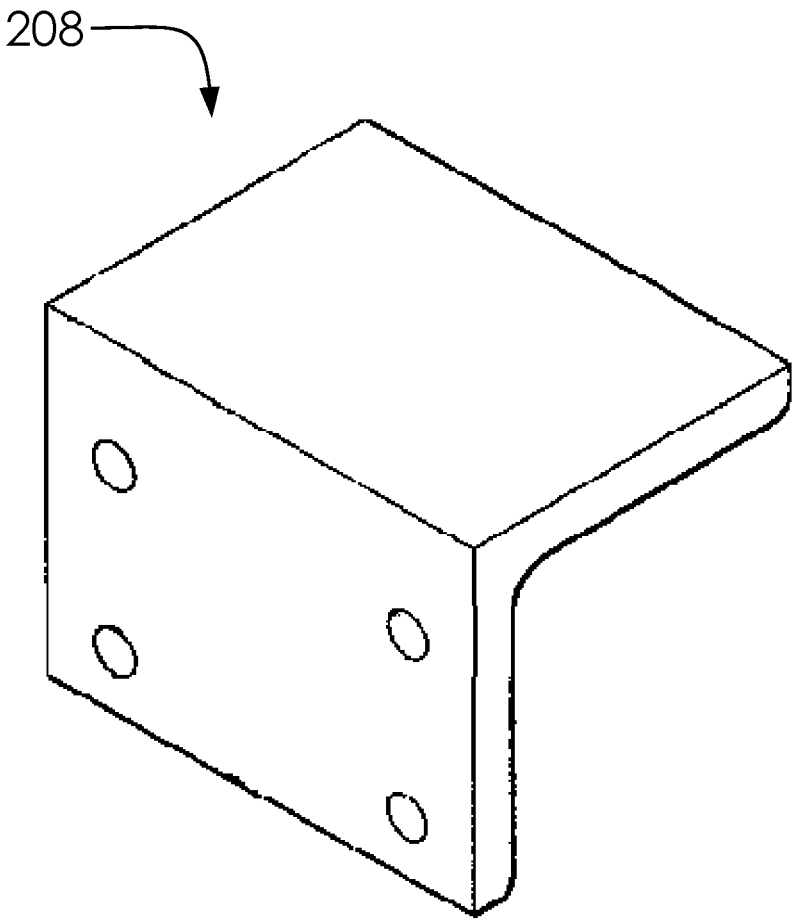
FIG. 35 illustrates a perspective overview of an airline bracket 208.

FIG. 35 illustrates a perspective overview of an airline bracket 208.

Figure 36A:
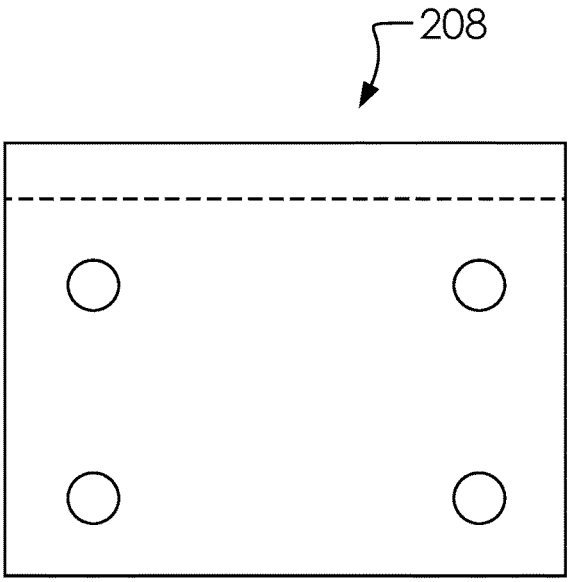
FIG. 36A illustrates an elevated back side view of an airline bracket 208.

FIG. 36A illustrates an elevated back side view of an airline bracket 208.

Figure 36B:
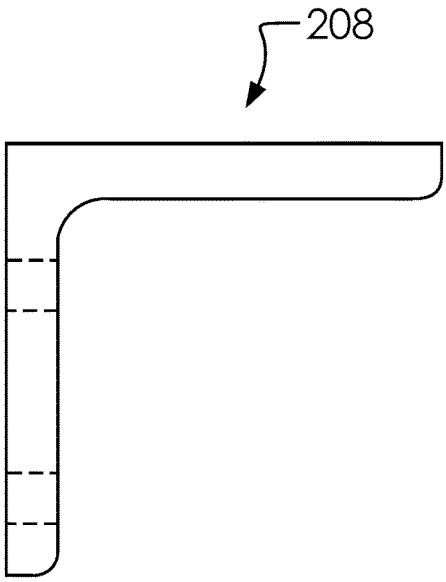
FIG. 36B illustrates an elevated first side view of an airline bracket 208.

FIG. 36B illustrates an elevated first side view of an airline bracket 208.

Figure 36C:
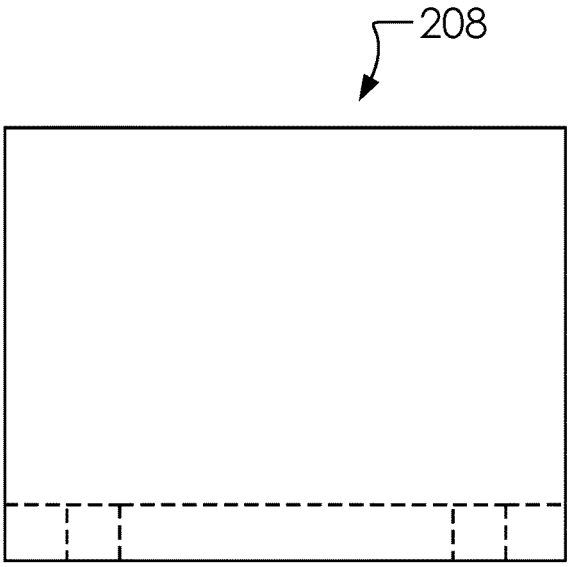
FIG. 36C illustrates an elevated top side view of an airline bracket 208.

FIG. 36C illustrates an elevated top side view of an airline bracket 208.

Figure 37A:
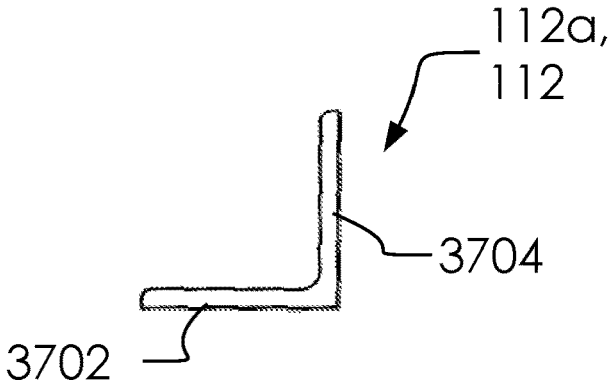
FIG. 37A illustrates an elevated top side view of a one or more leg covers 112.

FIG. 37A illustrates an elevated top side view of a one or more leg covers 112.

Figure 37B:
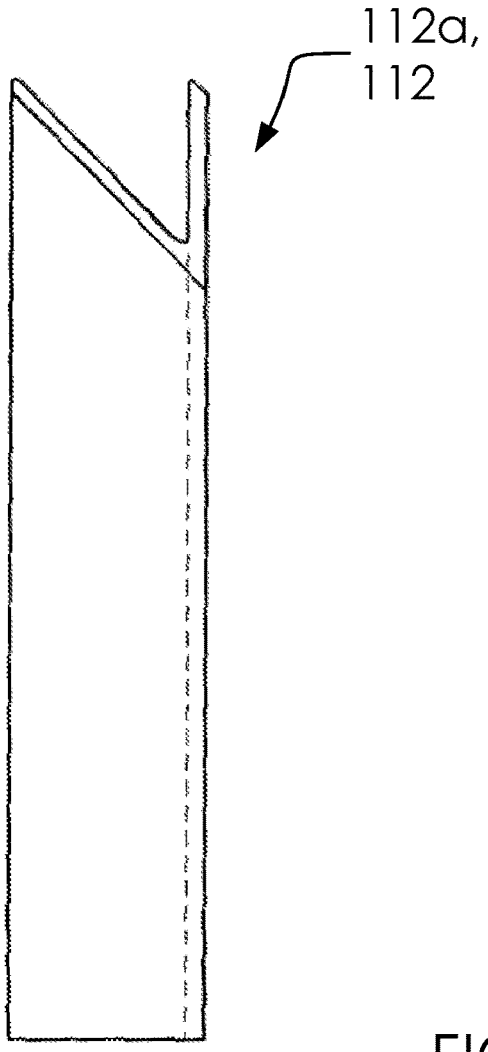
FIG. 37B illustrates an elevated front side view of a one or more leg covers 112.

FIG. 37B illustrates an elevated front side view of a one or more leg covers 112.

In one embodiment, said first leg cover 112*a* can comprise said first side 3702 and said second side 3704.

Figure 38:
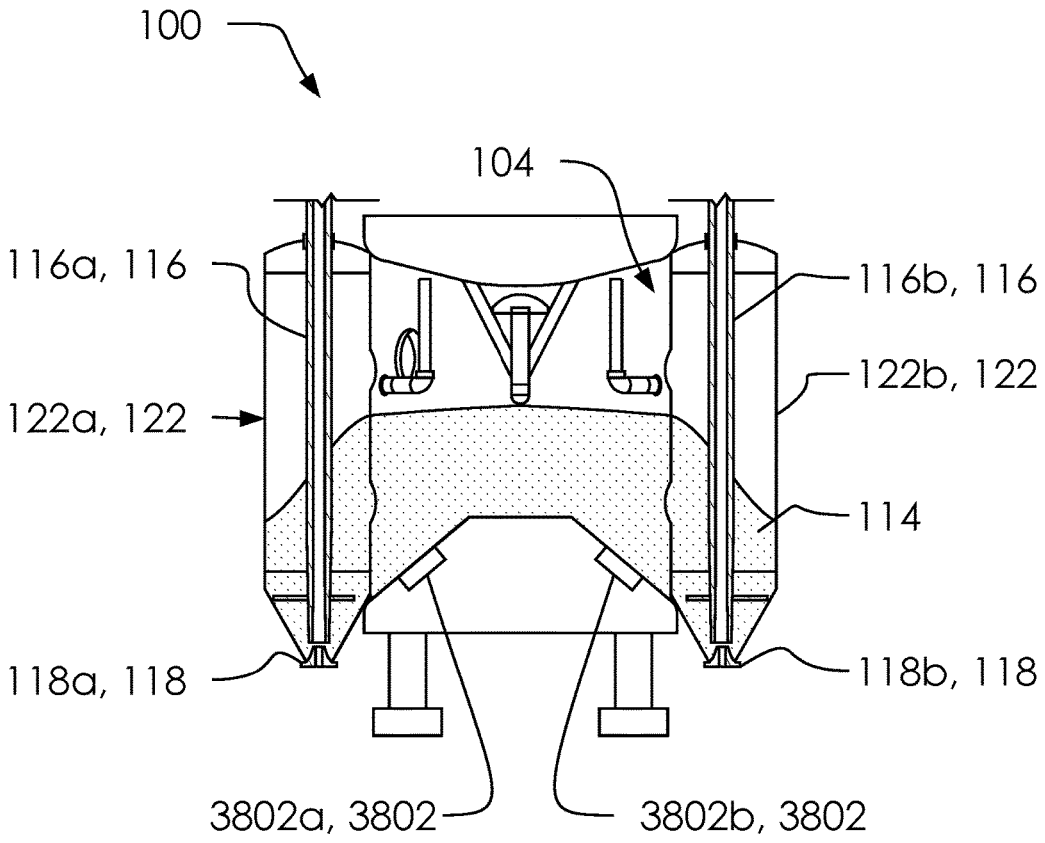
FIG. 38 illustrates an elevated front side view of a tank assembly 100 with a cross-section.

FIG. 38 illustrates an elevated front side view of a tank assembly 100 with a cross-section.

In one embodiment, said one or more vibrators 3802 can comprise said first vibrator 3802*a* and said second vibrator 3802*b*.

Said one or more vibrators 3802 can attach to said one or more vibrator mounting brackets 328. In one embodiment, said one or more vibrators 3802 can shake said shell assembly 104 and/or other portions of said tank assembly 100 to ensure said slurry mixture 114 move fluidly toward said one or more cone flanges 118.

Figure 39:
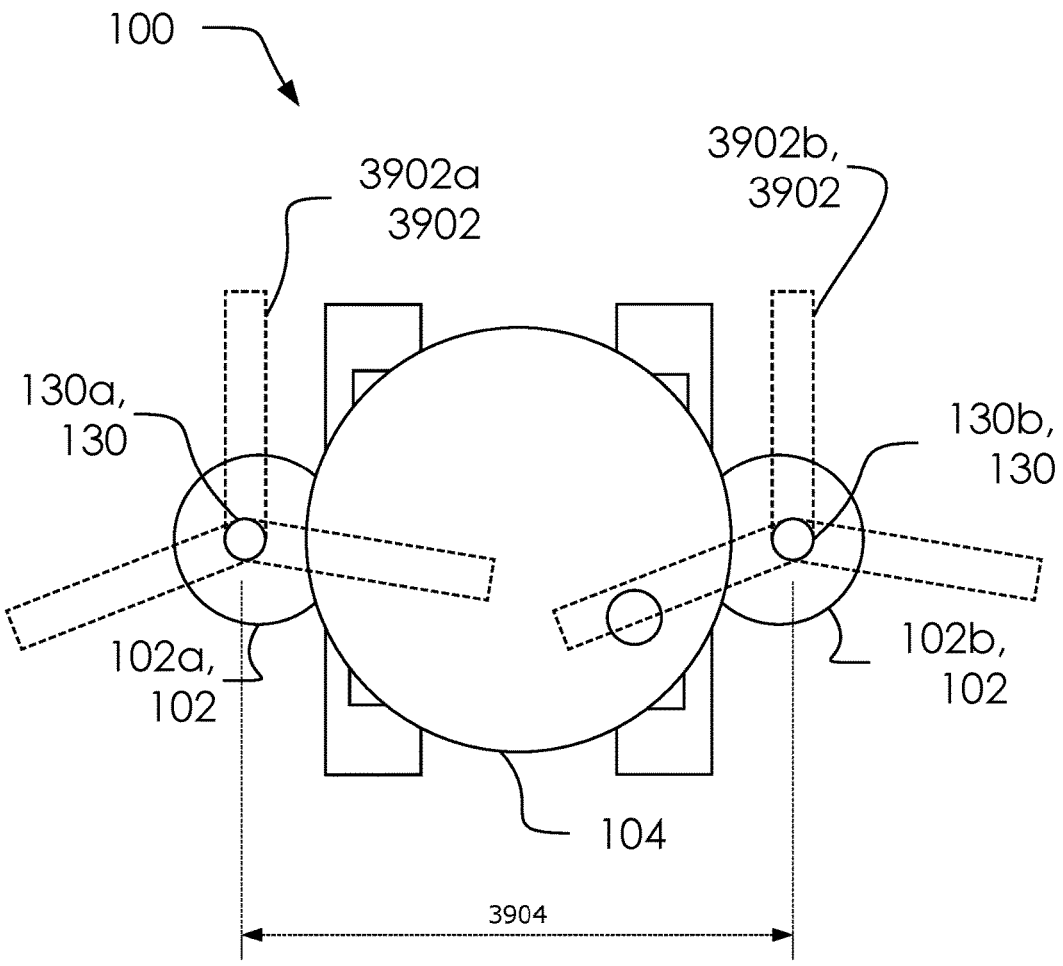
FIG. 39 illustrates an elevated top side view of a tank assembly 100.

FIG. 39 illustrates an elevated top side view of a tank assembly 100.

In one embodiment, said one or more spray equipment 3902 can comprise said first spray equipment 3902*a* and said second spray equipment 3902*b*.

In one embodiment, said tank assembly 100 can comprise said separation distance 3904.

In one embodiment, said one or more blister assemblies 102 can comprise said one or more spray equipment 3902 and said separation distance 3904.

In one embodiment, said first blister assembly 102*a* can comprise said first spray equipment 3902*a*.

In one embodiment, said second blister assembly 102*b* can comprise said second spray equipment 3902*b*.

In one embodiment, said one or more spray equipment's 3902 can attach to said one or more blister assemblies 102 and said one or more draw tubes 116 with a rotating radius at said one or more blister couplings 130, as illustrated.

In one embodiment, said one or more blister assemblies 102 can be separated by said separation distance 3904 being far enough apart that said one or more spray equipment's 3902 won't interfere with one another during rotation.

Since said one or more spray equipment's 3902 can be used separately, more than one user or purpose can be accomplished by said tank assembly 100 simultaneously. Each among said one or more spray equipment's 3902 can comprise an independent control system, and each of among said one or more spray equipment's 3902 can use different nozzle sizes.

Figure 40:
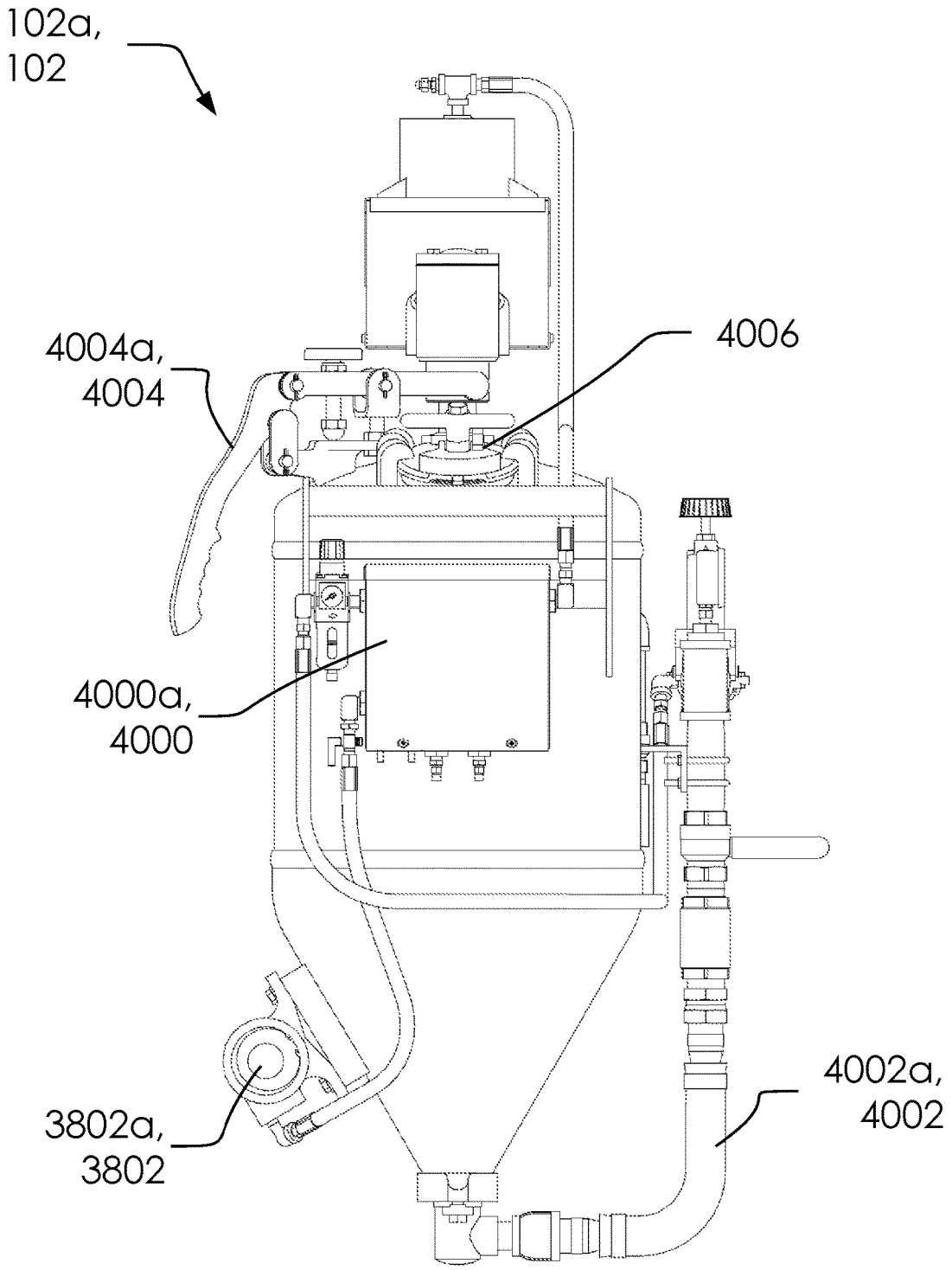
FIG. 40 illustrates an elevated front side view of a first blister assembly 102*a*.

FIG. 40 illustrates an elevated front side view of a first blister assembly 102*a*.

In one embodiment, said one or more control boxes 4000 can comprise said first control box 4000*a* and said second control box 4000*b*.

In one embodiment, said one or more air inlet hoses 4002 can comprise said first air inlet hose 4002*a* and said second air inlet hose 4002*b*.

In one embodiment, said one or more handles 4004 can comprise said first handle 4004*a* and said second handle 4004*b*.

In one embodiment, said tank assembly 100 can comprise said second control box 4000*b*, said second air inlet hose 4002*b* and said cap 4006.

Figure 41A:
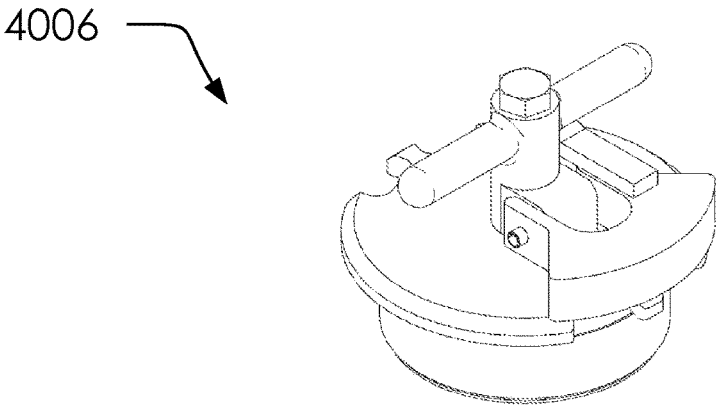
FIG. 41A illustrates a perspective overview of a cap 4006.

FIG. 41A illustrates a perspective overview of a cap 4006.

Figure 41B:
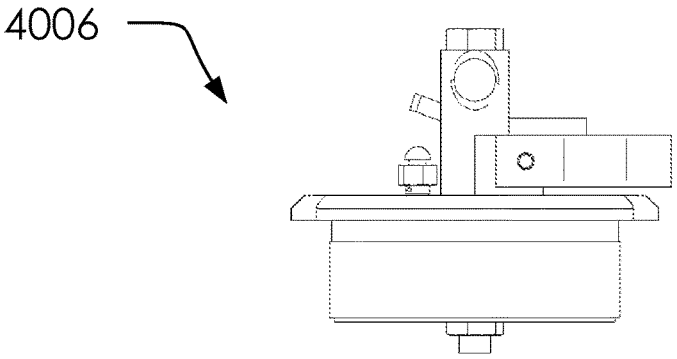
FIG. 41B illustrates an elevated front side view of a cap 4006.

FIG. 41B illustrates an elevated front side view of a cap 4006.

Figure 41C:
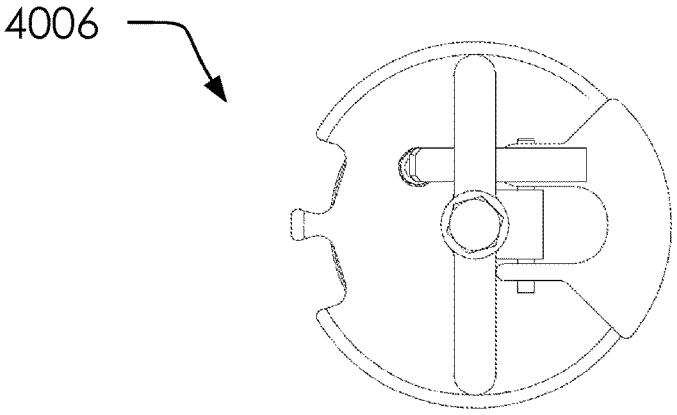
FIG. 41C illustrates an elevated top side view of a cap 4006.

FIG. 41C illustrates an elevated top side view of a cap 4006.

Figure 42A:
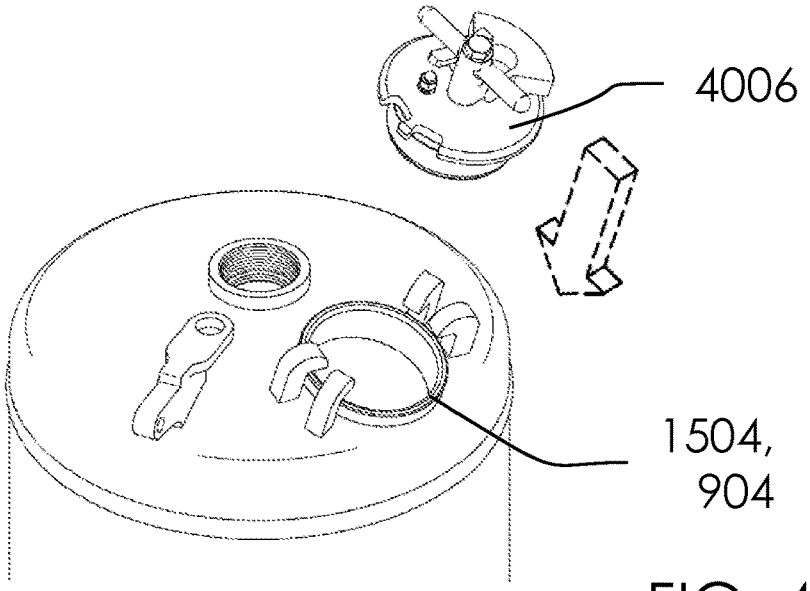
FIG. 42A illustrates a perspective overview of a cap 4006 detached.

FIG. 42A illustrates a perspective overview of a cap 4006 detached.

Figure 42B:
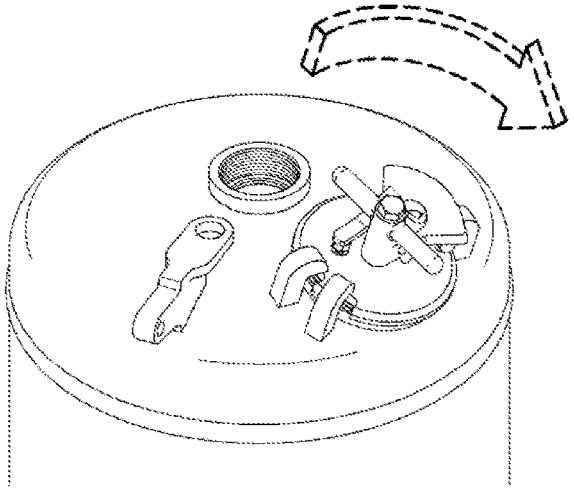
FIG. 42B illustrates a perspective overview of a cap 4006 attaching.

FIG. 42B illustrates a perspective overview of a cap 4006 attaching.

Figure 42C:
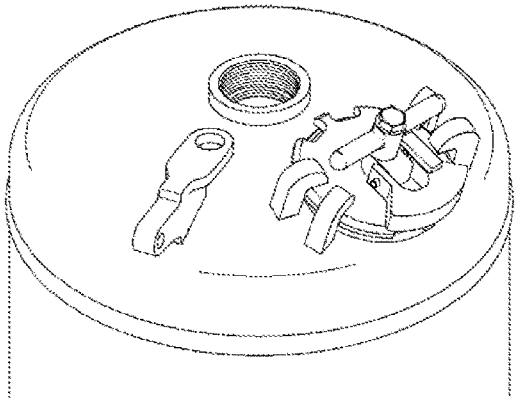
FIG. 42C illustrates a perspective overview of a cap 4006 attached.

FIG. 42C illustrates a perspective overview of a cap 4006 attached.

here, said hand hole rings 1504 and/or said fill ring 904 can receive said cap 4006. Illustrations from the parent application to this one is used as a illustration of a potential use of said cap 4006.

Figure 43A:
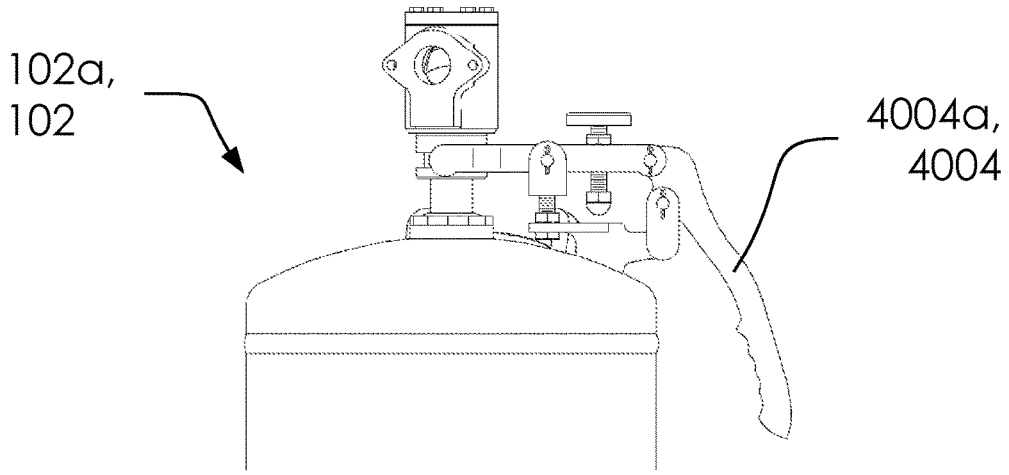
FIG. 43A illustrates an elevated front side view of a first handle 4004*a* in a first configuration.

FIG. 43A illustrates an elevated front side view of a first handle 4004*a* in a first configuration.

Figure 43B:
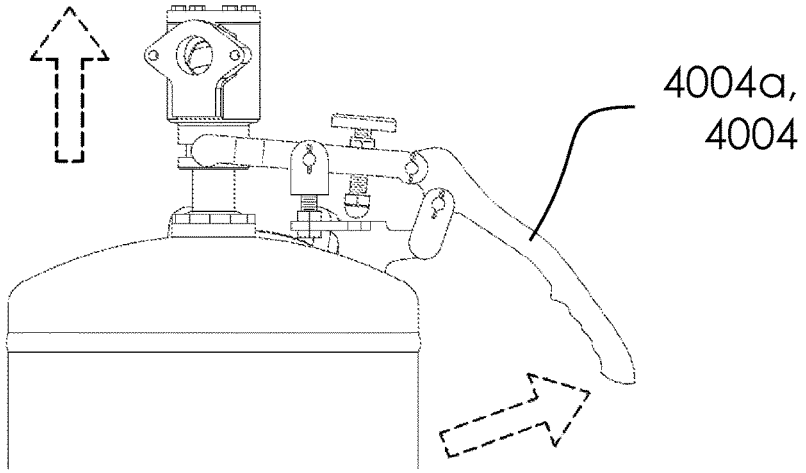
FIG. 43B illustrates an elevated front side view of a first handle 4004*a* in a second configuration.

FIG. 43B illustrates an elevated front side view of a first handle 4004*a* in a second configuration.

Figure 44A:
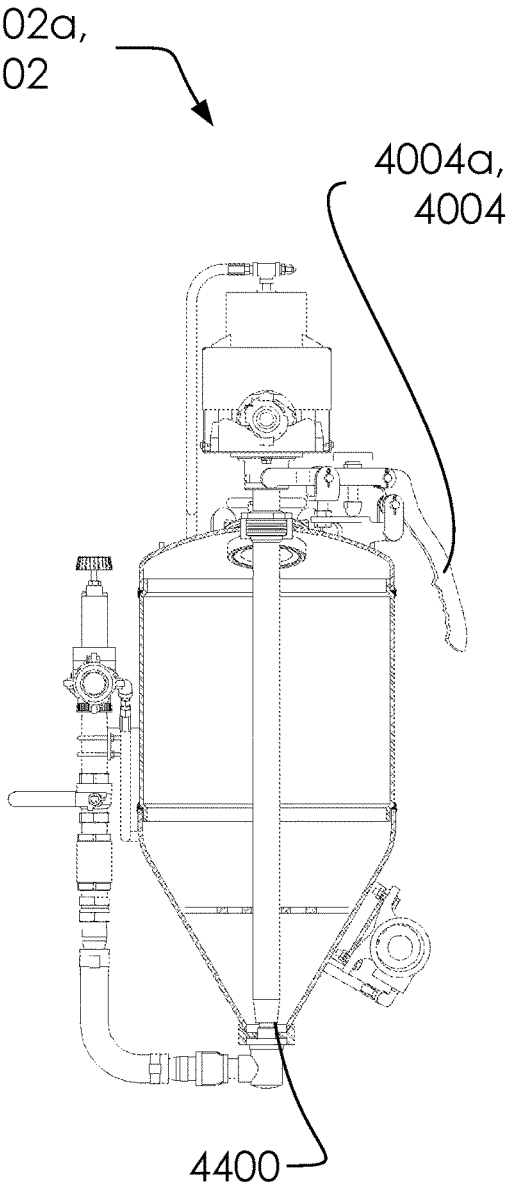
FIG. 44A illustrates an elevated front side view of a first configuration 4400.

FIG. 44A illustrates an elevated front side view of a first configuration 4400.

Figure 44B:
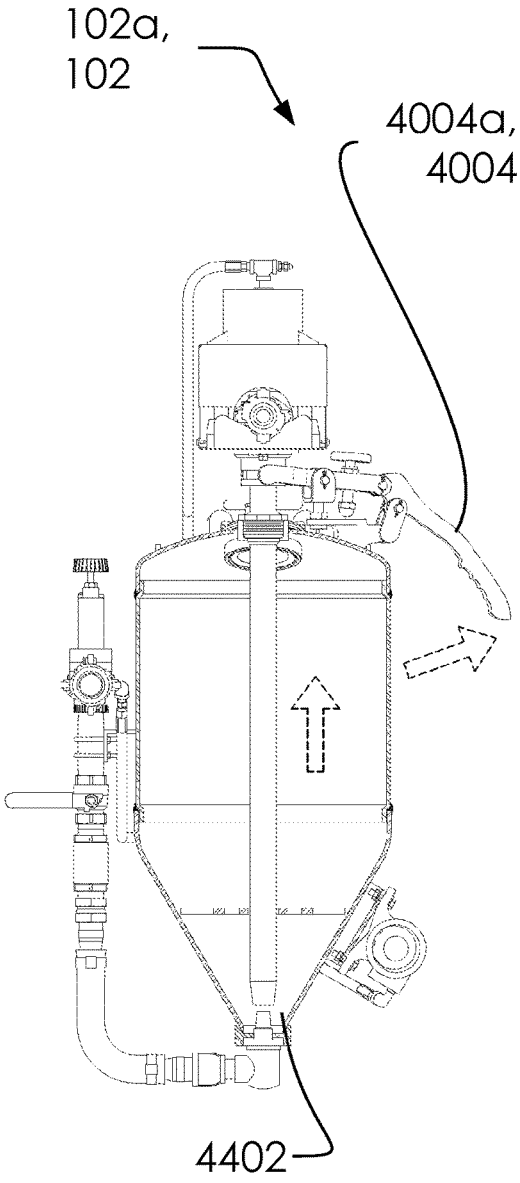
FIG. 44B illustrates an elevated front side view of a second configuration 4402.

FIG. 44B illustrates an elevated front side view of a second configuration 4402.

Figure 45:
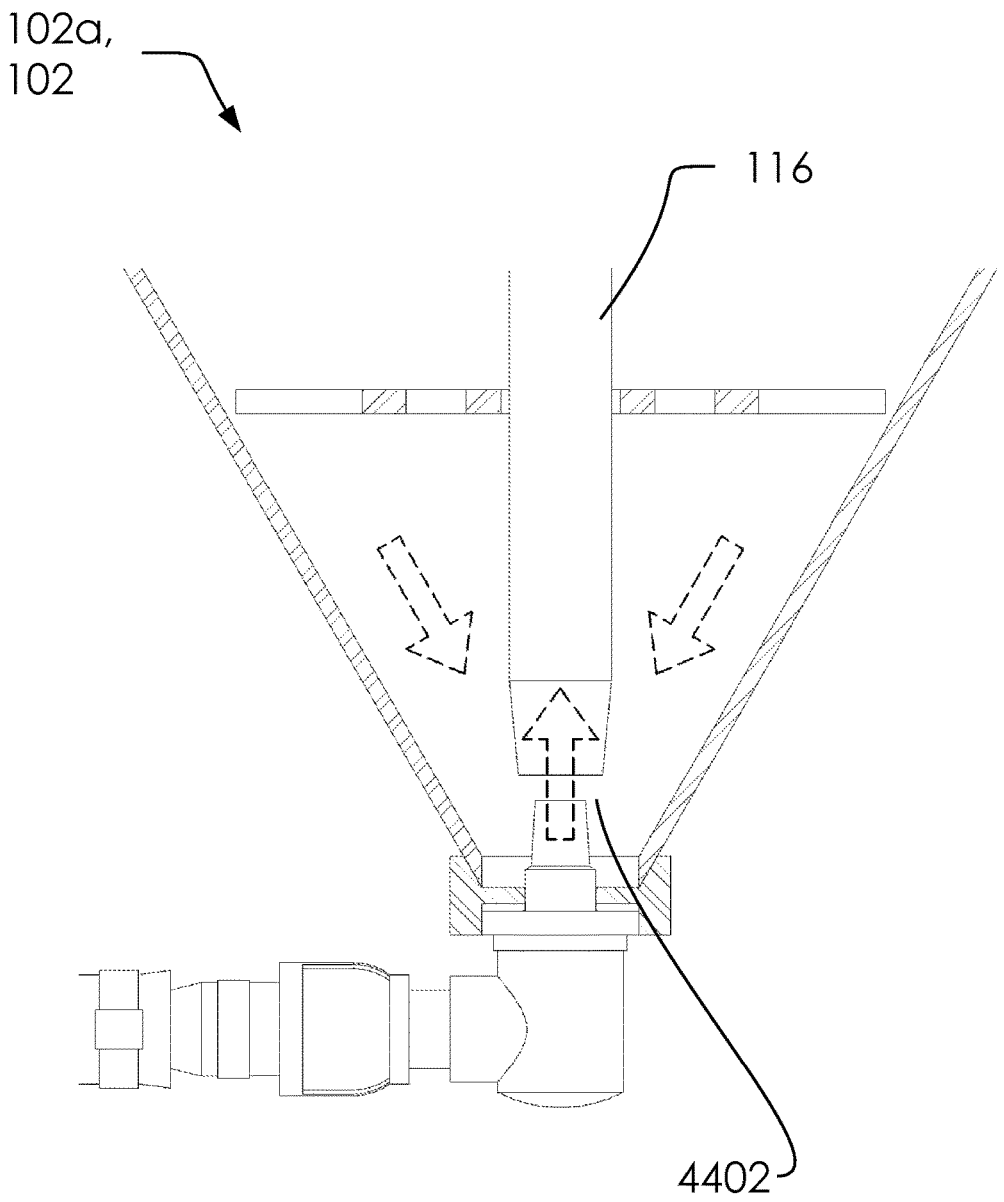
FIG. 45 illustrates an elevated front side view of a second configuration 4402.

FIG. 45 illustrates an elevated front side view of a second configuration 4402.

Figure 46:
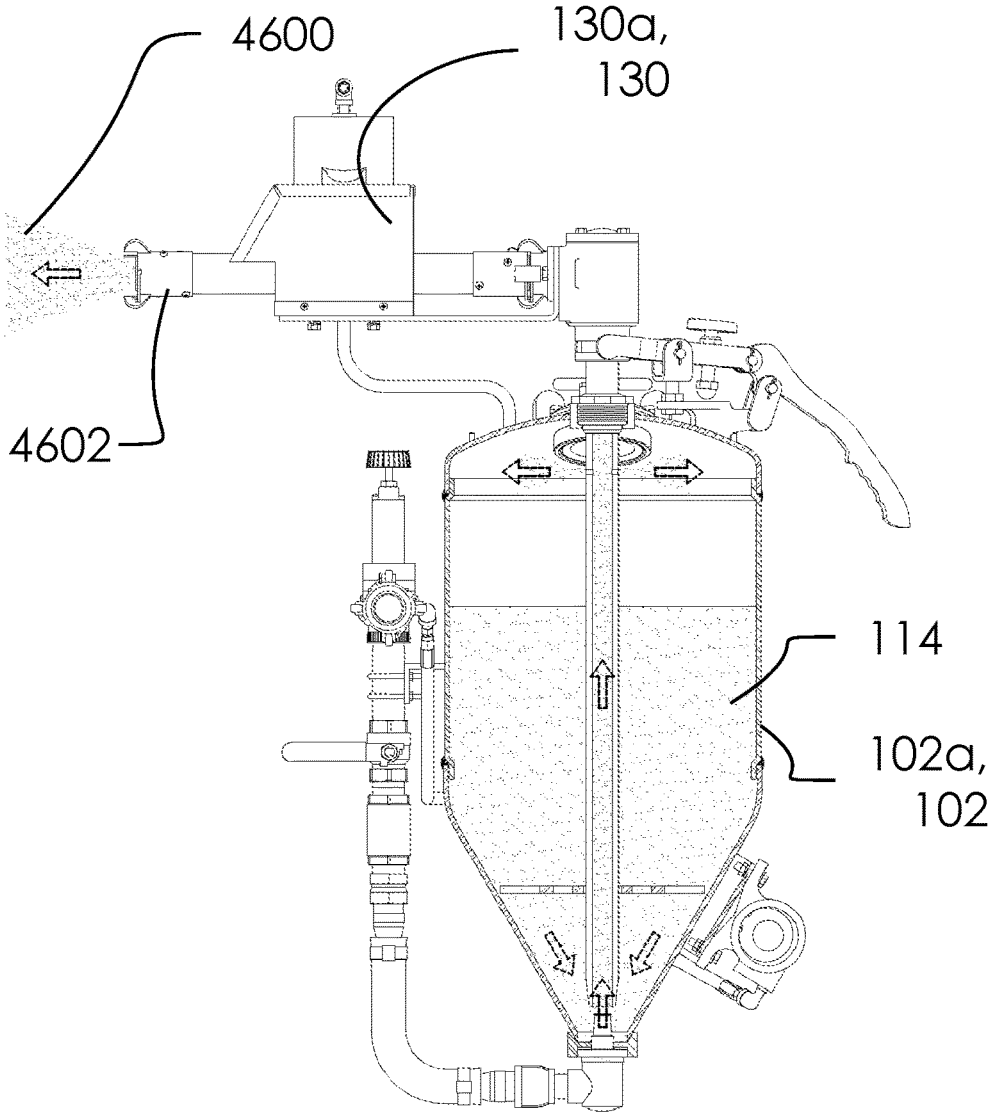
FIG. 46 illustrates an elevated front side view of a one or more blister assemblies 102 cross-section view in action.

FIG. 46 illustrates an elevated front side view of a one or more blister assemblies 102 cross-section view in action.

In one embodiment, said tank assembly 100 can comprise said nozzle 4602.

The following sentences are included for completeness of this disclosure with reference to the claims.

A tank assembly 100. Said tank assembly 100 comprises a one or more blister assemblies 102, a shell assembly 104, a one or more air inlet hoses 4002, a one or more spray equipment 3902 and a slurry mixture 114. Said one or more blister assemblies 102 comprises a first blister assembly 102*a* and a second blister assembly 102*b*. Said one or more blister assemblies 102 comprise a one or more draw tubes 116, a one or more cone flanges 118, a one or more head assemblies 120, a one or more shells 122, a one or more cone assemblies 124, an air line assembly 300, a one or more snorkel assemblies 330, and a separation distance 3904. Said one or more draw tubes 116 comprise a first draw tube 116*a* and a second draw tube 116*b*. Said separation distance 3904 between said one or more draw tubes 116 is configured to allow said one or more spray equipment 3902 to rotate freely on said one or more draw tubes 116 without interfering with one another. Said one or more draw tubes 116 selectively mate with said one or more cone flanges 118. Said one or more cone flanges 118 are attached at a lower point in said one or more cone assemblies 124 and gather portions of said slurry mixture 114. Said tank assembly 100 is configured to selectively channel said slurry mixture 114 into said one or more draw tubes 116 by opening a gap between said one or more draw tubes 116 and said one or more cone flanges 118. A tank assembly 100.

Said tank assembly 100 comprises a one or more blister assemblies 102, a shell assembly 104, a one or more air inlet hoses 4002, a one or more spray equipment 3902 and a slurry mixture 114. Said one or more blister assemblies 102 comprises a first blister assembly 102*a* and a second blister assembly 102*b*. Said one or more blister assemblies 102 comprise a one or more draw tubes 116, a one or more cone flanges 118, a one or more head assemblies 120, a one or more shells 122, a one or more cone assemblies 124, an air line assembly 300, a one or more snorkel assemblies 330, and a separation distance 3904. Said one or more draw tubes 116 comprise a first draw tube 116*a* and a second draw tube 116*b*.

Said one or more draw tubes 116 selectively mate with said one or more cone flanges 118.

Said one or more cone flanges 118 are attached at a lower point in said one or more cone assemblies 124 and gather portions of said slurry mixture 114. Said tank assembly 100 is configured to selectively channel said slurry mixture 114 into said one or more draw tubes 116 by opening a gap between said one or more draw tubes 116 and said one or more cone flanges 118.

Said separation distance 3904 between said one or more draw tubes 116 is configured to allow said one or more spray equipment 3902 to rotate freely on said one or more draw tubes 116 without interfering with one another.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A tank assembly, wherein:

said tank assembly comprises a one or more blister assemblies, a shell assembly, a one or more air inlet hoses, a one or more spray equipment and a slurry mixture;

said one or more blister assemblies comprises a first blister assembly and a second blister assembly;

said one or more blister assemblies comprise a one or more draw tubes, a one or more cone flanges, a one or more head assemblies, a one or more shells, a one or more cone assemblies, an air line assembly, a one or more snorkel assemblies, and a separation distance;

said one or more draw tubes comprise a first draw tube and a second draw tube;

said separation distance between said one or more draw tubes is configured to allow said one or more spray equipment to rotate freely on said one or more draw tubes without interfering with one another;

said one or more draw tubes selectively mate with said one or more cone flanges;

said one or more cone flanges are attached at a lower point in said one or more cone assemblies and gather portions of said slurry mixture; and said tank assembly is configured to selectively channel said slurry mixture into said one or more draw tubes by opening a gap between said one or more draw tubes and said one or more cone flanges.

2. A tank assembly, wherein:

said tank assembly comprises a one or more blister assemblies, a shell assembly, a one or more air inlet hoses, a one or more spray equipment and a slurry mixture;

said one or more blister assemblies comprises a first blister assembly and a second blister assembly;

said one or more blister assemblies comprise a one or more draw tubes, a one or more cone flanges, a one or more head assemblies, a one or more shells, a one or more cone assemblies, an air line assembly, a one or more snorkel assemblies, and a separation distance; and said one or more draw tubes comprise a first draw tube and a second draw tube.

3. The tank assembly from claim 2, wherein:

said one or more draw tubes selectively mate with said one or more cone flanges.

4. The tank assembly from claim 2, wherein:

said one or more cone flanges are attached at a lower point in said one or more cone assemblies and gather portions of said slurry mixture; and said tank assembly is configured to selectively channel said slurry mixture into said one or more draw tubes by opening a gap between said one or more draw tubes and said one or more cone flanges.

5. The tank assembly from claim 2, wherein:

said separation distance between said one or more draw tubes is configured to allow said one or more spray equipment to rotate freely on said one or more draw tubes without interfering with one another.

* * * * *